US008704754B2

(12) United States Patent
Machida et al.

(10) Patent No.: US 8,704,754 B2
(45) Date of Patent: Apr. 22, 2014

(54) ELECTROPHORETIC DRIVING METHOD AND DISPLAY DEVICE

(75) Inventors: Yoshinori Machida, Kanagawa (JP); Hiroaki Moriyama, Kanagawa (JP); Yasuo Yamamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 743 days.

(21) Appl. No.: 12/906,354

(22) Filed: Oct. 18, 2010

(65) Prior Publication Data

US 2011/0298835 A1 Dec. 8, 2011

(30) Foreign Application Priority Data

Jun. 7, 2010 (JP) ..... 2010-130318

(51) Int. Cl.
*G09G 3/34* (2006.01)

(52) U.S. Cl.
USPC ..... 345/107; 359/296

(58) Field of Classification Search
USPC ..... 345/107; 359/296
See application file for complete search history.

(56) References Cited

U.S. PATENT DOCUMENTS

| | | | | |
|---|---|---|---|---|
| 6,323,989 | B1 * | 11/2001 | Jacobson et al. | 359/296 |
| 6,531,997 | B1 * | 3/2003 | Gates et al. | 345/107 |
| 6,636,186 | B1 * | 10/2003 | Yamaguchi et al. | 345/31 |
| 6,822,782 | B2 * | 11/2004 | Honeyman et al. | 359/296 |
| 7,656,576 | B2 * | 2/2010 | Suwabe et al. | 359/296 |
| 7,848,009 | B2 * | 12/2010 | Machida et al. | 359/296 |
| 8,441,714 | B2 * | 5/2013 | Paolini et al. | 359/296 |
| 2008/0036731 | A1 * | 2/2008 | Shigehiro et al. | 345/107 |
| 2008/0112040 | A1 * | 5/2008 | Suwabe et al. | 359/296 |
| 2008/0117165 | A1 * | 5/2008 | Machida et al. | 345/107 |
| 2009/0046053 | A1 * | 2/2009 | Shigehiro et al. | 345/107 |
| 2010/0020384 | A1 * | 1/2010 | Machida et al. | 359/296 |
| 2010/0073281 | A1 * | 3/2010 | Moriyama et al. | 345/107 |

FOREIGN PATENT DOCUMENTS

| | | |
|---|---|---|
| JP | A-9-6277 | 1/1997 |
| JP | A-2000-194021 | 7/2000 |
| JP | A-2003-131420 | 5/2003 |
| JP | A-2006-58901 | 3/2006 |
| JP | B2-3991367 | 10/2007 |
| WO | WO 99/10767 | 3/1999 |
| WO | WO 99/10768 | 3/1999 |
| WO | WO 99/10769 | 3/1999 |

* cited by examiner

*Primary Examiner* — Jason Mandeville
(74) *Attorney, Agent, or Firm* — Oliff PLC

(57) ABSTRACT

A driving device of a display medium that including first and second particle groups migrating independently due to a first voltage being imparted for a first time period, forming aggregates due to the first voltage being imparted for a second time period, and the aggregates migrating due to a second voltage being imparted. The driving device includes a voltage imparting section that: imparts a third voltage that moves, to a display substrate side, a greater-amount-needed particle group for gradation display, in an amount of a difference between particles of the first particle group and second particle group needed for the display; when the greater-amount-needed particle group has an opposite polarity to the aggregates, imparts a fourth voltage that moves the aggregates needed to the display substrate side; and when the polarities are same, imparts a fifth voltage that moves the aggregates not needed to a rear substrate side.

9 Claims, 11 Drawing Sheets

ELECTROPHORETIC DRIVING METHOD AND DISPLAY DEVICE

CROSS-REFERENCE TO RELATED APPLICATION

This application is based on and claims priority under 35 USC 119 from Japanese Patent Application No. 2010-130318 filed on Jun. 7, 2010.

BACKGROUND

1. Technical Field

The present invention relates to a display medium driving device, a driving method, a driving program storage medium, and a display device.

2. Related Art

Display media using electrophoretic particles are known as display media at which repeated rewriting is possible. An electrophoretic display medium includes, for example, a pair of substrates that respectively have an electrode and that are disposed so as to face one another, and a particle group that is sealed between the substrates so as to move between the substrates in accordance with the electric field that is formed between the pair of substrates.

The particle group that is sealed between the pair of substrates may be one type of particle group that is colored a specific color, or may be plural types of particle groups that have respectively different colors and different electric field intensities needed for movement. For example, when two types of particle groups are included, the particles that are sealed-in are made to move by applying voltage between the pair of substrates at the display medium, and an image of a color, that corresponds to the amount of the particles that have moved to either one substrate side and the colors of the particles that have moved, is thereby displayed. Namely, by, in accordance with the color and the density of the image that is the object of display, applying, between the substrates, voltage of an intensity for moving the particle group that is the object of moving, the object particle group is moved toward either one side of the pair of substrates, and an image that corresponds to the color and the density of the object image is displayed.

SUMMARY

An aspect of the present invention is a driving device of a display medium that includes: a display substrate that is light-transmissive; a rear substrate that is disposed so as to face the display substrate with a gap therebetween; a front electrode that is disposed at the display substrate and is light-transmissive; a rear electrode that is disposed at the rear substrate; a dispersion medium that is disposed between the front electrode and rear electrodes; and two or more types of particle groups that are dispersed in the dispersion medium and that include a first particle group and a second particle group having different colors and charge polarities, the first particle group and the second particle group migrating independently of each other due to a first potential difference being imparted between the electrodes for a first time period, the first particle group and the second particle group forming aggregates that are charged positive or negative due to the first potential difference being imparted between the electrodes for a second time period that is shorter than the first time period, and the aggregates migrating due to a second potential difference that is smaller than the first potential difference being imparted, the driving device including a potential difference imparting section that: imparts, between the electrodes, a potential difference that forms the aggregates; imparts, between the electrodes, a third potential difference that moves, from the first particle group and the second particle group to the display substrate side, a particle group of which a greater amount of particles is needed for gradation display, in an amount of a difference between an amount of particles of the first particle group and an amount of particles of the second particle group needed for the display; when the particle group of which a greater amount of particles is needed for the gradation display has an opposite polarity to the aggregates, imparts, between the electrodes, a fourth potential difference that moves an amount of the aggregates needed for the gradation display to the display substrate side; and when the particle group of which a greater amount of particles is needed for the gradation display has the same polarity as the aggregates, imparts, between the electrodes, a fifth potential difference that moves an amount of the aggregates not needed for the gradation display to the rear substrate side.

BRIEF DESCRIPTION OF THE DRAWINGS

Exemplary embodiments of the present invention will be described in detail based on the following figures, wherein.

DETAILED DESCRIPTION

The present inventors found that, when carrying out display that corresponds to colors of respective particle groups by using two or more types of electrophoretic particle groups, depending on the combination of the migrating particles, aggregates of different types of particle groups are formed during the migration in accordance with the intensity and time of the voltage applied between the electrodes, and the particles migrate as aggregates. Further, the present inventors found that, by using particle groups, in which the respective particle groups migrate independently or as aggregates in accordance with the voltage that is applied between the electrodes, and by controlling the voltage applied between the electrodes, display of colors of the aggregates formed by these different types of particle groups also is realized in addition to display of colors of the respective particle groups.

Exemplary embodiments of the present invention are described hereinbelow with reference to the drawings. Members that have the same operations and functions are denoted by the same reference symbols throughout all of the drawings, and repeat description thereof may be omitted. Further, in order to simplify explanation, the present exemplary embodiments are described by using drawings that focus on one cell.

Particles that are cyan are called cyan particles C, particles that are magenta are called magenta particles M, and particles that are yellow are called yellow particles Y. The respective particles and the particle groups thereof are denoted by the same symbols (reference symbols).

Further, aggregates that are formed by different types of these particle groups are denoted by combining the symbols that express the respective particle groups. For example, an aggregate of cyan particles C and magenta particles M is called aggregate CM, and similarly, aggregates may be indicated as aggregate CY, aggregate MY, aggregate CMY, and the like.

First Exemplary Embodiment

Figure 1A:
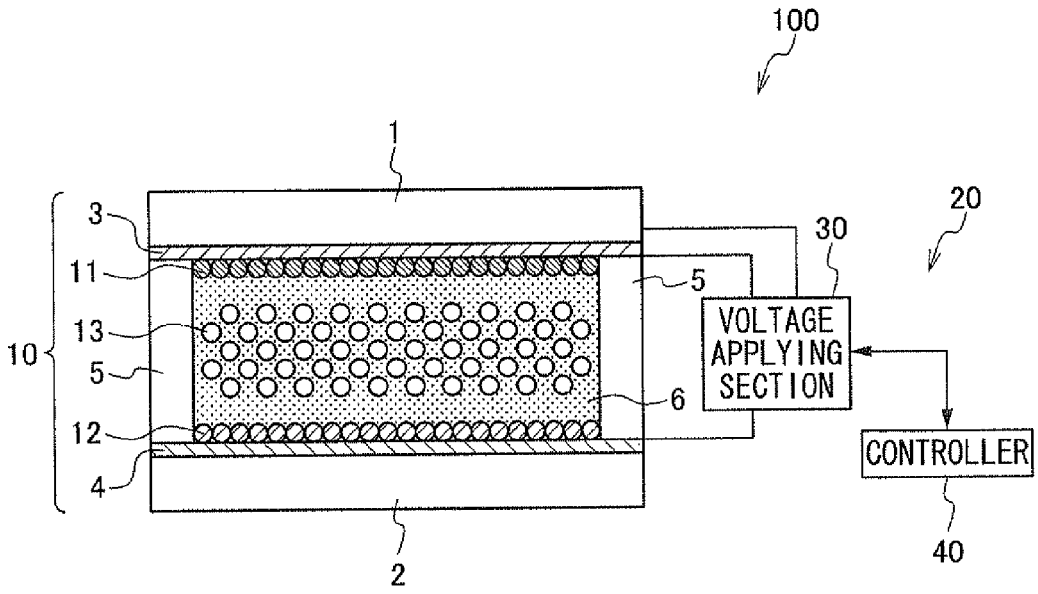
FIGS. 1A and 1B are schematic drawings showing a display device relating to a first exemplary embodiment.

A display device relating to a first exemplary embodiment is shown schematically in FIG. 1A. A display device 100 has a display medium 10, and a driving device 20 that drives the display medium 10. The driving device 20 includes a voltage applying section 30 that applies voltage between a pair of electrodes 3, 4 of the display medium 10, and a controller 40 that controls the voltage applying section 30 in accordance with image information (data) of the image to be displayed on the display medium 10.

At the display medium 10, a display substrate 1 that is an image display surface, and a rear substrate 2 that is a non-display surface, are disposed so as to oppose one another with a gap therebetween.

Spacing members 5 are provided that maintain the interval between the substrates 1, 2 at a set interval and that section the region between the substrates into plural cells.

The cell expresses a region that is enclosed by the rear substrate 2 at which the rear electrode 4 is provided, the display substrate 1 at which the front electrode 3 is provided, and the spacing members 5. A dispersion medium 6, and a first particle group 11, a second particle group 12 and a white particle group 13, that are dispersed in the dispersion medium 6, are sealed in the cell.

The colors and the charge polarities of the first particle group 11 and the second particle group 12 are different from one another. The first particle group 11 and the second particle group 12 have the characteristics that, by providing a first potential difference in accordance with the voltage that is applied between the pair of electrodes 3, 4, the first particle group 11 and the second particle group 12 respectively migrate independently, and, by providing a second potential difference that is smaller than the first potential difference, the first particle group 11 and the second particle group 12 form aggregates that are charged positive or negative and migrate. The charge amount of the white particle group 13 is smaller than those of the first particle group 11 and the second particle group 12. The white particle group 13 is a particle group that does not move to either electrode side, even when voltage, that is such that the first particle group 11, the second particle group 12 or aggregates formed by these particle groups move to either one electrode side, is applied between the electrodes.

First, the structural members of the display device relating to the present exemplary embodiment are described concretely.

—Display Substrate and Rear Substrate—

The display substrate 1, or both the display substrate 1 and the rear substrate 2 have, light-transmitting property.

A front electrode 3 is formed at the display substrate 1, and a rear electrode 4 is formed at the rear substrate 2.

Examples of the display substrate 1 and the rear substrate 2 include a glass or plastic substrate, such as a substrate of polyethylene terephthalate resin, polycarbonate resin, acrylic resin, polyimide resin, polyester resin, epoxy resin, or polyether sulfone resin.

The respective thicknesses of the display substrate 1 and the rear substrate 2 are, for example, from 50 μm to 3 mm.

For the front electrode 3 and the rear electrode 4, materials including an oxide of indium, tin, cadmium, antimony, or the like, a complex oxide such as ITO, a metal such as gold, silver, copper, or nickel, or an organic material such as polypyrrole or polythiophene may be used. These substances may be used to form a single-layer film, a mixed film, or a composite film by, for example, vacuum deposition, sputtering, or coating.

The thickness of each electrode is generally from 100 Å to 2,000 Å when vacuum deposition or sputtering is used. The rear electrode 4 and the front electrode 3 may be formed into a desired pattern, such as a matrix or a stripe (with which passive matrix driving is possible), by a conventional measure such as etching of a conventional liquid-crystal-display medium or a conventional printed board.

The front electrode 3 may be embedded in the display substrate 1. The rear electrode 4 may be embedded in the rear substrate 2.

In order to achieve active matrix driving, a TFT (thin film transistor) may be provided at each pixel. In consideration of ease of stacking of wiring and component mounting, the TFT may be formed on the rear substrate 2 rather than on the display substrate 1.

—Spacing Member—

The spacing member 5, which maintains the space between the display substrate 1 and the rear substrate 2, is formed such that the light-transmitting property of the display substrate 1 is not impaired, and may be formed from, for example, a thermoplastic resin, a thermosetting resin, an electron-beam-curable resin, a photo-curable resin, rubber, or a metal.

The spacing member 5 may be integrated with either of the display substrate 1 or the rear substrate 2. In this case, the spacing member 5 may be prepared by subjecting the substrate to an etching process, a laser processing, a press machining using a mold prepared in advance, or a printing process.

The spacing member 5 is formed at either of the display substrate 1 or the rear substrate 2, or at the both.

The spacing member 5 may be either colored or colorless, but it is preferably colorless and transparent in order avoid adverse effects on an image displayed on the display medium. A transparent resin, such as polystyrene, polyester, or an acrylic resin may be used for the spacing member 5.

It is also preferable to be transparent when a spacing member in a form of particles or spherical shape is used as the spacing member 5. A glass particle or a transparent resin particle such as a particle of polystyrene, polyester, or an acrylic resin may be adopted for such spacing member.

Note that the term "transparent" indicates herein that the substance has a transmittance of 60% or more to visible light.

—Dispersion Medium—

The dispersion medium 6 in which the migrating particles are dispersed may be an insulating liquid. Note that, the term "insulating" herein means that the volume resistivity is $10^{11}$ Ω·cm or more.

Examples of the insulating liquid include: hexane, cyclohexane, toluene, xylene, decane, hexadecane, kerosene, paraffin, isoparaffin, silicone oil, dichloroethylene, trichloroethylene, perchloroethylene, high purity petroleum, ethyleneglycol, alcohols, ethers, esters, dimethyl formamide, dimethyl acetoamide, dimethyl sulfoxide, N-methylpyrrolidone, 2-pyrrolidone, N-methyl formamide, acetonitrile, tetrahydrofuran, propylene carbonate, ethylene carbonate, benzene, diisopropyl naphthalene, olive oil, isopropanol, trichlorotrifluoroethane, tetrachloroethane, dibromotetrafluoroethane, and a mixture of two or more thereof. Among these, silicone oil is preferably used.

Further, by removing impurities so as to attain the following volume resistivity, water (pure water) may be used as the dispersion medium. The volume resistivity is preferably $10^3$ Ω·cm or more, more preferably from $10^7$ Ω·cm to $10^{19}$ Ω·cm, and further more preferably from $10^{10}$ Ω·cm to $10^{19}$ Ω·cm.

One or more substances selected from the following may be added to the insulating liquid as required: an acid, an alkali, a salt, a dispersion stabilizer, a stabilizer for anti-oxidation, UV absorption or the like, an antibacterial agent, and an antiseptic agent. These substances are preferably added in an extent such that the volume resistivity falls within the above-described range.

A charge control agent selected from the following may be added to the insulating liquid: an anionic surfactant, a cationic surfactant, an amphoteric surfactant, a nonionic surfactant, a fluorochemical surfactant, a silicone surfactant, a metal soap, an alkyl phosphate, or a succinimide.

More specific examples of the ionic or nonionic surfactant include the following substances. Examples of the nonionic surfactant include polyoxyethylene nonylphenyl ether, polyoxyethylene octylphenyl ether, polyoxyethylene dodecylphenyl ether, polyoxyethylene alkyl ether, polyoxyethylene fatty acid ester, sorbitan fatty acid ester, polyoxyethylene sorbitan fatty acid ester, and fatty acid alkylol amide. Examples of the anionic surfactant include an alkylbenzene sulfonate, an alkylphenyl sulfonate, an alkylnaphthalene sulfonate, a higher fatty acid salt, a salt of a sulfuric ester of a higher fatty acid, and a sulfonic acid of a higher fatty acid ester. Examples of the cationic surfactant include a primary amine salt, a secondary amine salt, a tertiary amine salt, and a quaternary ammonium salt.

The amount of the charge control agent is preferably from 0.01% by weight to 20% by weight, and particularly preferably from 0.05% by weight to 10% by weight, with respect to the solid amount of the particles.

The dispersion medium 6 may include a polymer resin in addition to the insulating liquid. The polymer resin may be a polymer gel, a high-molecular-weight polymer, or the like.

Examples of the polymer resin include natural polymers such as agarose, agaropectin, amylase, sodium alginate, alginic acid propylene glycol ester, isolichenan, insulin, ethylcellulose, ethylhydroxyethylcellulose, curdlan, casein, carrageenan, carboxymethylcellulose, carboxymethyl starch, callose, agar, chitin, chitosan, silk fibroin, guar gum, quince seed, crown-gall polysaccharide, glycogen, glucomannan, keratan sulfate, keratin protein, collagen, cellulose acetate, gellan gum, schizophyllan, gelatin, ivory palm mannan, tunicin, dextran, dermatan sulfate, starch, tragacanth gum, nigeran, hyaluronic acid, hydroxyethylcellulose, hydroxypropylcellulose, pustulan, funoran, decomposed xyloglucan, pectin, porphyran, methylcellulose, methyl starch, laminaran, lichenan, lentinan, and locust bean gum. Further, almost any kind of synthetic polymers may be also used for the polymer resin.

Further, the polymer resin may be a polymer that contains, in a repetition unit thereof, a functional group selected from an alcohol, a ketone, an ether, an ester, or an amide. Examples of such polymer include polyvinyl alcohol, poly(meth)acrylamide or a derivative thereof, polyvinyl pyrrolidone, polyethylene oxide, and a copolymer containing two or more of these polymers.

Among these, gelatin, polyvinyl alcohol, or poly(meth) acrylamide is preferable for the polymer resin.

Colors that are different than the colors of the migrating particles may be displayed by mixing a colorant with the dispersion medium 6.

The colorant mixed with the dispersion medium 6 may be a known colorant, and examples thereof include: carbon black; titanium oxide; magnesium oxide; zinc oxide; phthalocyanine copper-based cyan colorants; azo-based yellow colorants; azo-based magenta colorants; quinacridone-based magenta colorants; red colorants; green colorants; and blue colorants. Specifically, typical examples thereof include aniline blue, chalcoil blue, chrome yellow, ultramarine blue, Dupont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment blue 15:1, and C.I. pigment blue 15:3.

The viscosity of the dispersion medium 6 may be controlled since while the particles 11 and 12 move in the dispersion medium 6, if the viscosity of the dispersion medium 6 exceeds a predetermined value, the force acting to the rear substrate 2 and the display substrate 1 varies largely, and it may be unable to determine an electric field threshold for the moving of the particles.

The viscosity of the dispersion medium 6 in an environment at 20° C. may be from 0.1 mPa·s to 100 mPa·s, preferably from 0.1 mPa·s to 50 mPa·s, and more preferably from 0.1 mPa·s to 20 mPa·s.

The viscosity of the dispersion medium 6 may be controlled by regulating the molecular weight, structure, and composition of the dispersion medium 6. The viscosity herein is measured using a B-8L viscosity meter manufactured by TOKYO KEIKI INC.

—Electrophoretic Particle—

The present exemplary embodiment uses, as the electrophoretic particles, two or more types of particle groups that include the first particle group 11 and the second particle group 12, whose colors and charge polarities are different from one another, and in which, in accordance with the voltage that is applied between the pair of electrodes, the first particle group 11 and the second particle group 12 respectively migrate independently, or the first particle group 11 and the second particle group 12 form aggregates that are charged positive or negative and migrate.

The aggregating force between particle groups of different types is controlled by, for example, adhering a polymer dispersing agent for controlling the aggregating ability to the surfaces of the particles that structure these particle groups. For example, if silicone oil is used as the dispersion medium and a polymer dispersing agent that is compatible with silicone oil is adhered to the surfaces of the particles, the polymer dispersing agent spreads within the dispersion medium 6. Accordingly, if the two types of migrating particle groups 11, 12 both have this polymer dispersing agent on the surfaces thereof, the polymer dispersing agents at the surfaces of the respective particles of the particle groups repel one another, and it is difficult for the particle groups to aggregate.

The aggregating force between particle groups of different types may be controlled by, for example, adjusting the charge amounts of the particles that structures these particle groups. For example, if the charge amounts of the two types of migrating particle groups 11, 12 are large, the particle groups aggregate with one another easily due to static electric force.

The structure and the method of producing and the like of the migrating particles are described below.

—White Particles—

The white particles may be, for example, particles in which a white pigment such as titanium oxide, silicon oxide, or zinc oxide is dispersed in polystyrene, polyethylene, polypropylene, polycarbonate, PMMA, acrylic resin, phenol resin, a formaldehyde condensate, or the like. Polystyrene particles or polyvinyl naphthalene particles may also be used as the white particles.

The means for fixing the display substrate 1, at which the front electrode 3 is provided, and the rear substrate 2, at which the rear electrode 4 is provided, to one another via the spacing members 5 is not particularly limited. For example, fixing means such as a combination of bolts and nuts, clamps, clips, a frame for substrate fixing, or the like may be used. Further, fixing means such as an adhesive, heat fusion, ultrasonic joining, or the like may be used.

The display medium that is structured in this way is used for devices for carrying out storing and rewriting of images, for example, notice boards, circulars, electronic blackboards, advertisements, signboards, flashing signs, electronic paper, electronic newspapers, electronic documents, document sheets commonly used by copiers and printers, and the like.

—Voltage Applying Section and Controller—

Due to the driving device 20 (the voltage applying section 30 and the controller 40) imparting a first potential difference between the pair of electrodes 3, 4 of the display medium 10, the particle groups 11, 12 respectively migrate independently, and are pulled to either one of the pair of electrodes 11, 12 in accordance with the respective charge polarities. Due to the driving device 20 imparting a second potential difference that is smaller than the first potential difference, aggregates of these particle groups 11, 12 are formed and migrate, and are pulled to either one of the pair of electrodes 11, 12 in accordance with the charge polarity of these aggregates.

In accordance with such control, displays of four colors that are the respective color displays by the respective particle groups 11, 12, and color display by aggregates of these different types of particle groups, and color display by the white particle group 13 that does not migrate within the dispersion medium 6, are realized.

The voltage applying section 30 is electrically connected to the front electrode 3 and the rear electrode 4, respectively.

The voltage applying section 30 is connected so as to be able to transmit and receive signals to and from the controller 40.

Figure 1B:
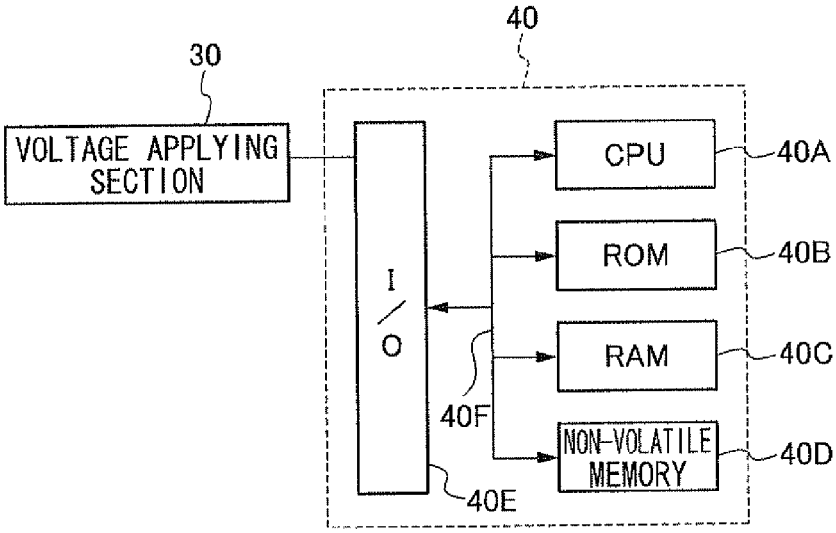

As shown in FIG. 1B, the controller 40 may be structured as the computer 40. The computer 40 is structured such that a Central Processing Unit (CPU) 40A, a Read Only Memory (ROM) 40B, a Random Access Memory (RAM) 40C, a non-volatile memory 40D, and an input/output interface (I/O) 40E are respectively connected via a bus 40F. The voltage applying section 30 is connected to the I/O 40E. In this case, a program, that causes the computer 40 to execute the processing that will be described below of instructing the voltage applying section 30 to apply the voltage needed for display of the respective colors, may be written-in the non-volatile memory 40D, and the CPU 40A may read-out and execute this program. Note that the program may be provided from a recording medium such as a CD-ROM or the like.

The voltage applying section 30 is a voltage applying device for applying voltage to the front electrode 3 and the rear electrode 4. The voltage applying section 30 applies voltages, that are in accordance with the control of the controller 40, to the front electrode 3 and the rear electrode 4 respectively, and imparts a potential difference.

Figure 2:
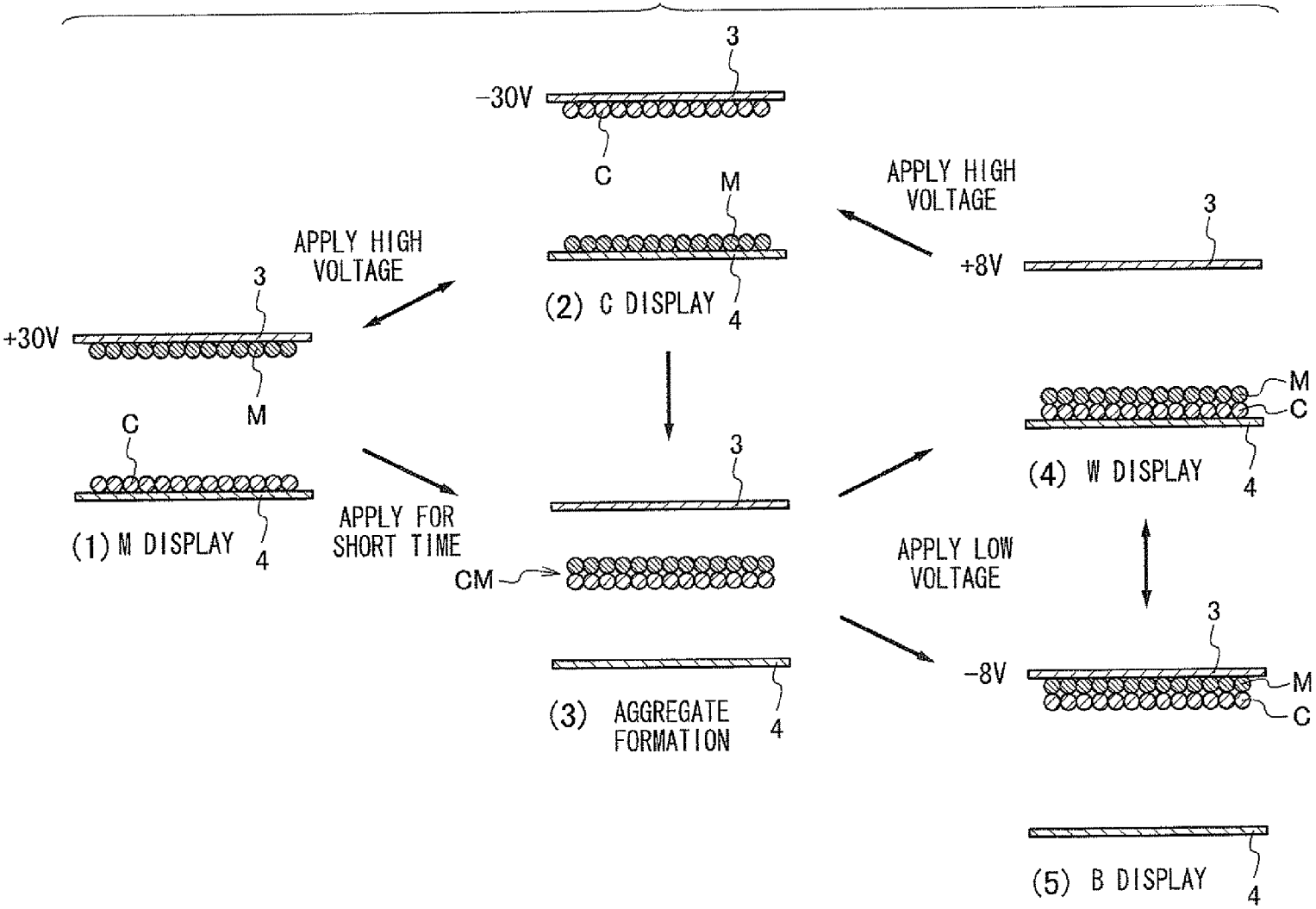
FIG. 2 is a schematic drawing showing behavior of migrating particles in accordance with voltage application in the display device relating to the first exemplary embodiment.

FIG. 2 schematically shows the behavior of the migrating particles 11, 12 that corresponds to the application of voltage at the display medium relating to the first exemplary embodiment. Note that the white particles 13, the dispersion medium 6, the substrates at the both surfaces (the display substrate 1 and the rear substrate 2), the spacing members 5, and the like are omitted from FIG. 2.

In the present exemplary embodiment, description is given of a case in which the first particles 11 are negative-charge electrophoretic particles that have a magenta hue (magenta particles M), the second particles 12 are positive-charge electrophoretic particles that have a cyan hue (cyan particles C), and the aggregates have overall positive charge. However, the present invention is not limited to the same, and it suffices for the colors and the charge polarities of the respective particles to be set appropriately, and the aggregates may have overall negative charge. Further, the values of the voltages that are applied in the following description also are examples, and the present invention is not limited to the same. It suffices to set the voltage values appropriately in accordance with the charge polarities and the responsivenesses of the respective particles, the distance between the electrodes, and the like.

Figure 3:
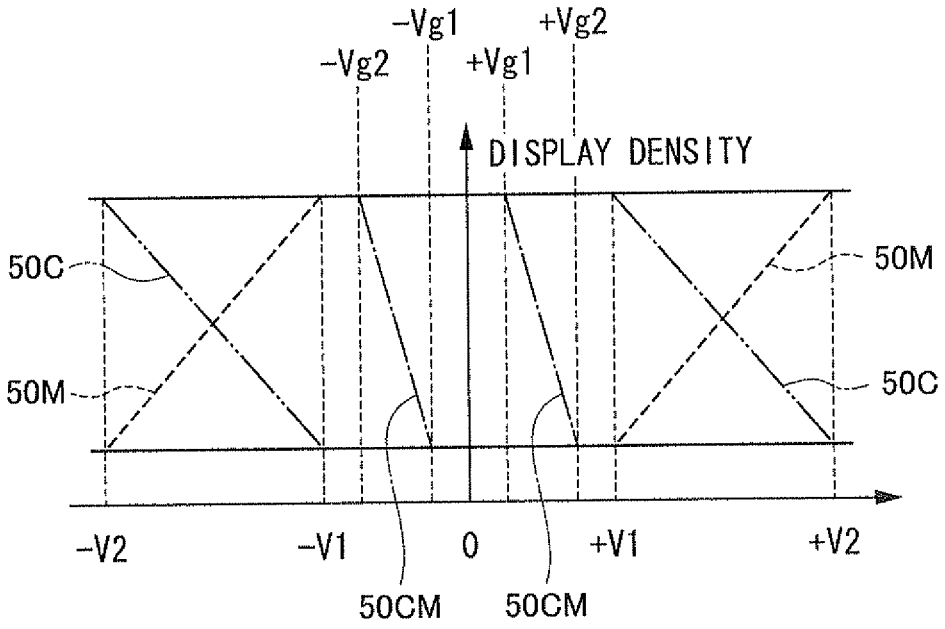
FIG. 3 is a drawing showing the voltage application characteristics of respective migrating particles relating to the first exemplary embodiment.

FIG. 3 shows characteristics of applied voltages that are needed in order to move the cyan particles C, the magenta particles M, and the aggregates CM of the cyan particles C and the magenta particles M to the display substrate 1 side and the rear substrate 2 side in the display device 100 relating to the present exemplary embodiment. In FIG. 3, the applied voltage characteristic of the cyan particles C is expressed as characteristic 50C, the applied voltage characteristic of the magenta particles M is expressed as characteristic 50M, and the applied voltage characteristic of the aggregates CM is expressed as characteristic 50CM.

FIG. 3 shows the relationships between pulse voltage that is applied to the front electrode 3 with the rear electrode 4 being ground (0 V), and the display densities by the respective particle groups.

As shown in FIG. 3, the movement starting voltage (threshold voltage) at which the magenta particles M at the rear substrate 2 side start to move toward the display substrate 1 side is +V1 (e.g., +10 V), and the movement ending voltage at which the magenta particles M at the rear substrate 2 side finish moving toward the display substrate 1 side is +V2 (e.g., +30 V).

The movement starting voltage at which the magenta particles M at the display substrate 1 side start to move toward the rear substrate 2 side is −V1 (e.g., −10 V), and the movement ending voltage at which the magenta particles M at the display substrate 1 side finish moving toward the rear substrate 2 side is −V2 (e.g., −30 V).

Further, as shown in FIG. 3, the movement starting voltage at which the cyan particles C at the rear substrate 2 side start to move toward the display substrate 1 side is −V1, and the movement ending voltage at which the cyan particles C at the rear substrate 2 side finish moving toward the display substrate 1 side is −V2.

The movement starting voltage at which the cyan particles C at the display substrate 1 side start to move toward the rear substrate 2 side is +V1, and the movement ending voltage at which the cyan particles C at the display substrate 1 side finish moving toward the rear substrate 2 side is +V2. Note that voltages in the range of |V1| to |V2| are voltages corresponding to the first potential difference.

Further, as shown in FIG. 3, the movement starting voltage at which the aggregates CM at the rear substrate 2 side start to move toward the display substrate 1 side is −Vg1 (e.g., −3 V), and the movement ending voltage at which the aggregates CM at the rear substrate 2 side finish moving toward the display substrate 1 side is −Vg2 (e.g., −8 V).

The movement starting voltage at which the aggregates CM at the display substrate 1 side start to move toward the rear substrate 2 side is +Vg1 (e.g., +3 V), and the movement ending voltage at which the aggregates CM at the display substrate 1 side finish moving toward the rear substrate 2 side is +Vg2 (e.g., +8 V). Note that voltages in the range of |Vg1| to |Vg2| are voltages corresponding to the second potential difference.

Display of the respective colors is described next. Note that the rear electrode 4 is ground (0 V). Further, same amounts of the magenta particles M and the cyan particles C are sealed between the substrates.

—Magenta Display—

As shown in (1) of FIG. 2, when voltage of +V2 (e.g., +30 V) is applied to the front electrode 3, the negative-charge magenta particles M migrate to the front electrode 3 and the positive-charge cyan particles C migrate to the rear electrode 4, respectively independently, and the particles adhere to the entire surfaces of the respective electrodes. Due thereto, magenta color by the magenta particle group is displayed (M display) through the front electrode 3 and the display substrate 1.

—Cyan Display—

As shown in (2) of FIG. 2, when voltage of −V2 (e.g., −30 V) is applied to the front electrode 3, the positive-charge cyan particles C migrate to the front electrode 3 and the negative-charge magenta particles M migrate to the rear electrode 4, respectively independently, and the particles adhere to the entire surfaces of the respective electrodes. Due thereto, cyan color by the cyan particle group C is displayed (C display) through the front electrode 3 and the display substrate 1.

—White Display—

Given that the time until the display switches from magenta display to cyan display due to the positive/negative of the voltages that are applied to the respective electrodes 3, 4 being reversed is Tmc (corresponding to a first time, e.g., 1 second), if, in the state of magenta display, voltage of a short pulse of a shorter time (corresponding to a second time, e.g., 0.3 seconds) than Tmc is applied and the voltage is turned off (0 V), as shown in (3) of FIG. 2, the respective particle groups move away from the electrodes 3, 4, and form aggregates (the aggregates CM) in the midst of migrating toward the opposing electrode. Or, given that the time until the display switches from cyan display to magenta display is Tem (e.g., 1 second), in the state of cyan display, the aggregates may be formed by applying voltage for a time period (e.g., 0.3 seconds) that is shorter than Tcm.

The aggregates have overall negative charge or positive charge in accordance with the sizes, the magnitudes of the charge amounts, the numbers, and the like of the respective particles C, M that structure the aggregates. Description is given in the present exemplary embodiment of a case in which the aggregates are positive charge, but the aggregates may be negative charge.

Then, when voltage that is low to the extent that the aggregates CM move as aggregates without separating into the respective particle groups, for example, voltage of +Vg2 (e.g., +8 V) is applied to the front electrode 3, as shown in (4) of FIG. 2, the positive-charge aggregates migrate to the rear electrode 4 side, and adheres to the rear electrode 4. When viewed from the display substrate side at this time, white display (W display) is obtained due to the white particle group (not shown in FIG. 2) that is dispersed in the dispersion medium without migrating. Note that white display may be realized without using white particles by using a white dispersion medium liquid.

Note that, at the time of white display, the display is changed to magenta display (M display) by applying a higher voltage that separates the aggregates CM into the respective particle groups, for example, by applying voltage of +V2 to the front electrode 3.

—Blue Display—

When aggregates are once formed from magenta display or cyan display and, for example, voltage of −Vg2 (e.g., −8 V) is applied to the front electrode 3, the positive-charge aggregates CM migrate to the front electrode side and adheres to the front electrode 3, as shown in (5) of FIG. 2. Due thereto, the display changes to blue display (B display) by the aggregates of the magenta particle group and the cyan particle group.

When, in the white display, voltage that separates the aggregates CM into the respective types of particles, e.g., voltage of +V2 is applied to the front electrode 3, the cyan particles C are pulled to the front electrode 3 side and the magenta particles M are pulled to the rear electrode side, and the display changes to cyan display (C display).

As described above, two types of electrophoretic particle groups are used that not only migrate independently, but also, when a predetermined voltage is applied, form aggregates of different types of particles and migrate. By controlling the intensity and the time of the voltages that are applied to the respective electrodes 3, 4, display of four colors is realized.

Gradation Display of Magenta—

When voltage of +V2 is applied to the front electrode 3 in the state shown in (3) of FIG. 2, i.e., the state in which the aggregates CM are formed in the liquid, the magenta particles M move to the front electrode 3 and the cyan particles C move to the rear electrode 4 side, and magenta is displayed.

Figure 4:
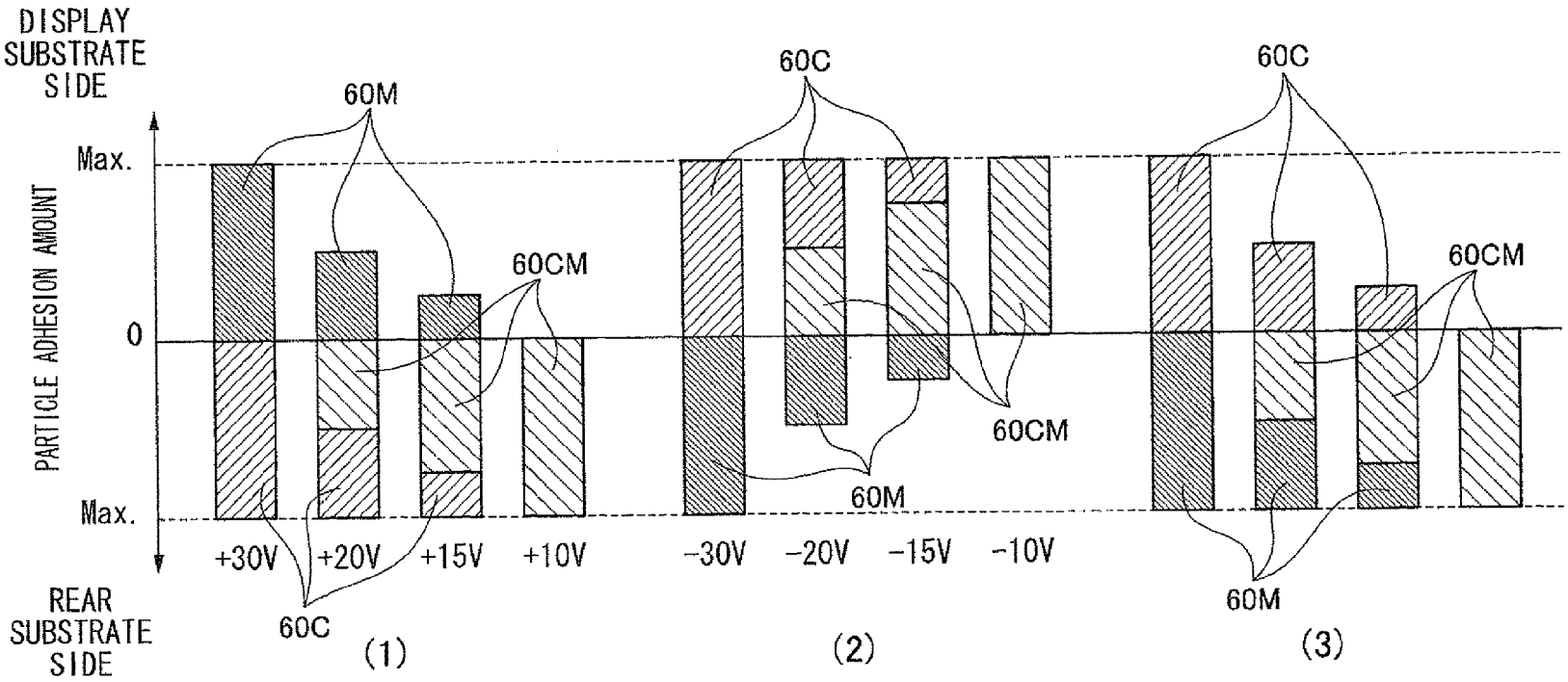
FIG. 4 is a drawing for explaining concrete examples of voltage application when gradation-displaying magenta or cyan.

In FIG. 4, graph (1) shows amounts of particles that move toward the display substrate 1 side and the rear substrate 2 side when the rear electrode 4 is ground (0 V) and +30 V, +20 V, +15 V, +10 V are applied to the front electrode 3. Note that, in FIG. 4 and the respective drawings thereafter, the particle amount of the magenta particles M is expressed as 60M, the moved amount of the cyan particles C is expressed as 60C, and the moved amount of the aggregates CM is expressed as 60CM.

As shown in the graph (1), when voltage of +30 V, that is greater than or equal to +V2, is applied to the front electrode 3, all of the aggregates CM dissociate, and all of the magenta particles M move to the display substrate 1 side, and all of the cyan particles C move to the rear substrate 2 side.

When voltage of +20 V, that is from +V1 to +V2, is applied to the front electrode 3, around 50% for example of all of the magenta particles M dissociate from the aggregates CM and move to the display substrate 1 side. Further, the aggregates CM, in which the remaining approximately 50% of the magenta particles M and around 50% of all of the cyan particles C are aggregated, move to the rear substrate 2 side. The remaining approximately 50% of the cyan particles C dissociate from the aggregates CM and move to the rear substrate 2 side.

When voltage of +15 V, that is from +V1 to +V2, is applied to the front electrode 3, around 30% for example of all of the magenta particles M dissociate from the aggregates CM and move to the display substrate 1 side. Further, the aggregates CM, in which the remaining approximately 70% of the magenta particles M and around 70% of all of the cyan particles C are aggregated, move to the rear substrate 2 side. The remaining approximately 30% of the cyan particles C dissociate from the aggregates CM and move to the rear substrate 2 side.

When voltage of +10 V, that is from +Vg2 to +V1, is applied to the front electrode 3, the aggregates CM do not dissociate. The aggregates CM, in which all of the magenta particles M and all of the cyan particles C are aggregated, move to the rear substrate 2 side.

Accordingly, when carrying out gradation display of magenta, it suffices to, in the state in which the aggregates CM are formed in the liquid, apply voltage within the range of from +V1 to +V2 to the front electrode 3 in accordance with the desired gradation.

—Gradation Display of Cyan—

Graph (2) of FIG. 4 shows amounts of particles that move toward the display substrate 1 side and the rear substrate 2 side when the rear electrode 4 is ground (0 V) and −30 V, −20 V, −15 V, −10 V are applied to the front electrode 3.

As shown in the graph (2), when voltage of −30 V, that is less than or equal to −V2, is applied to the front electrode 3, all of the aggregates CM dissociate, and all of the cyan particles C move to the display substrate 1 side, and all of the magenta particles M move to the rear substrate 2 side.

When voltage of −20 V, that is from −V2 to −V1, is applied to the front electrode 3, around 50% for example of all of the cyan particles C dissociate from the aggregates CM and move to the display substrate 1 side. The aggregates CM, in which the remaining approximately 50% of the cyan particles C and around 50% of all of the magenta particles M are aggregated, move to the display substrate 1 side. Further, the remaining approximately 50% of the magenta particles M dissociate from the aggregates CM and move to the rear substrate 2 side.

When voltage of −15 V, that is from −V2 to −V1, is applied to the front electrode 3, around 30% for example of all of the cyan particles C dissociate from the aggregates CM and move to the display substrate 1 side. The aggregates CM, in which the remaining approximately 70% of the cyan particles C and around 70% of all of the magenta particles M are aggregated, moves to the display substrate 1 side. Further, the remaining approximately 30% of the magenta particles M dissociate from the aggregates CM and move to the rear substrate 2 side.

When voltage of −10 V, that is from −V1 to −Vg2, is applied to the front electrode 3, the aggregates CM do not dissociate. The aggregates CM, in which all of the magenta particles M and all of the cyan particles C are aggregated, move to the display substrate 1 side.

In this way, merely by applying a voltage of from −V2 to −V1 to the front electrode 3, the aggregates CM of the same charge polarity as the cyan particles C move toward the display substrate 1 side.

Therefore, in the state shown in graph (2) voltage of +Vg2 is applied to the display substrate 3. Due thereto, as shown in graph (3) of FIG. 4, the aggregates CM, that have once moved to the display substrate 1 side, move to the rear substrate 2 side, and only the cyan particles C remain at the display substrate 1 side.

In this way, when carrying out gradation display of the cyan particles C, it suffices to, from the state in which the aggregates CM are formed in the liquid, apply voltage within a range of from −V2 to −V1 to the front electrode 3 in accordance with the desired gradation, and thereafter, by applying voltage of +Vg2 to the front electrode 3, to move the aggregates CM, that have once moved to the display substrate 1 side, to the rear substrate 2 side.

—Blue (Color of Aggregates CM) Gradation Display—

Figure 5:
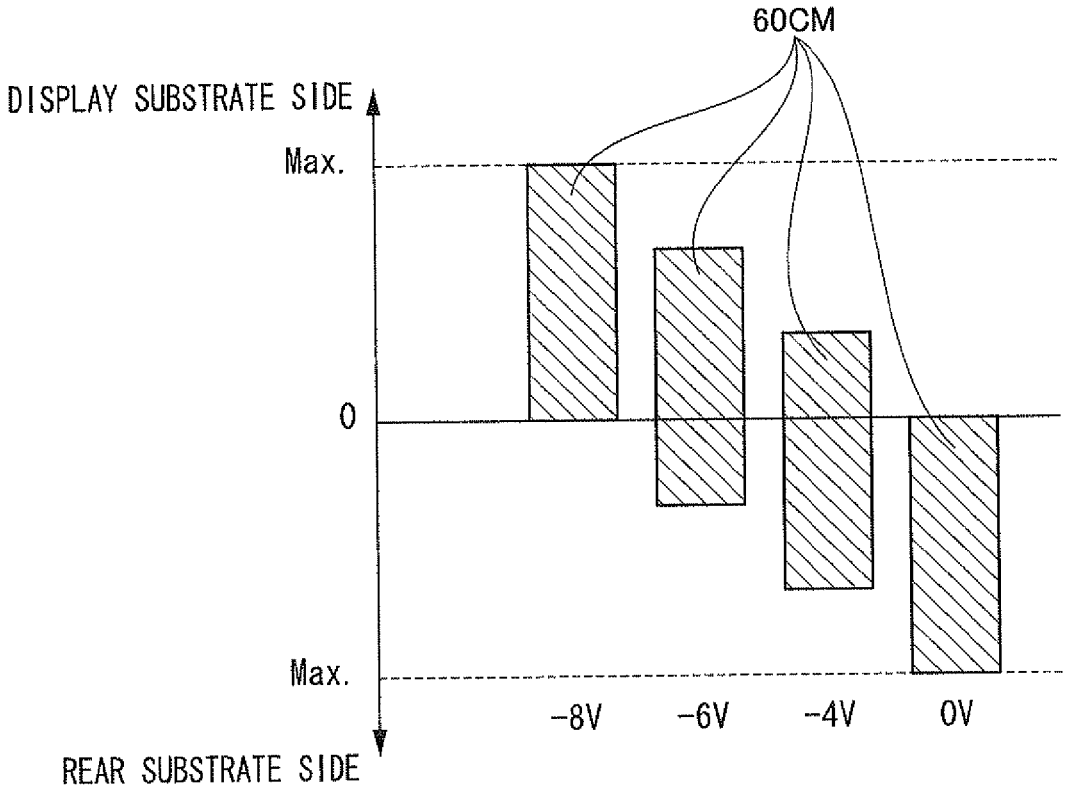
FIG. 5 is a drawing for explaining concrete examples of voltage application when gradation-displaying blue.

FIG. 5 shows amounts of the aggregates CM that move toward the display substrate 1 side and the rear substrate 2 side when voltages of −8 V, −6 V, −4 V, 0 V, that are voltages from −Vg2 to −Vg1, are applied to the front electrode 3 in the state in which voltage of +Vg2 has been applied to the front electrode 3 and all of the aggregates CM have moved to the rear substrate 2 side in the state shown in (3) of FIG. 2, i.e., the state in which the aggregates CM are formed in the liquid.

Note that, with regard to the aggregates CM, not all of the magenta particles M and the cyan particles C aggregate into a single clump, but the aggregates CM are stabilized in a state in which the magenta particles M and the cyan particles C aggregate to a size of a certain extent. For example, numerous aggregates of around several μm are formed, and the respective aggregates move between the substrates.

As shown in FIG. 5, when voltage of −8 V that is −Vg2 is applied to the front electrode 3, all of the aggregates CM move to the display substrate 1 side.

When voltage of −6 V is applied to the front electrode 3, around 70% for example of all of the aggregates CM move to the display substrate 1 side, and the remaining approximately 30% of the aggregates move to the rear substrate 2 side.

When voltage of −4 V is applied to the front electrode 3, around 30% for example of all of the aggregates CM move to the display substrate 1 side, and the remaining approximately 70% of the aggregates move to the rear substrate 2 side.

When voltage of 0 V is applied to the front electrode 3, all of the aggregates CM remain as is at the rear substrate 2 side.

Accordingly, when carrying out gradation display of blue that is the color of the aggregates CM, it suffices to, in the state in which the aggregates CM are formed in the liquid and have all moved to the rear substrate 2 side, apply a voltage in the range of from −Vg2 to −Vg1 to the front electrode 3 in accordance with the desired gradation.

Note that gradation display may also be carried out by, in the state in which the aggregates CM are formed in the liquid and have all moved to the display substrate 1 side, applying a voltage in the range of from +Vg1 to +Vg2 to the front electrode 3 in accordance with the gradation.

—Blue (Color of Aggregates CM) Tonal Display—

Figure 6:
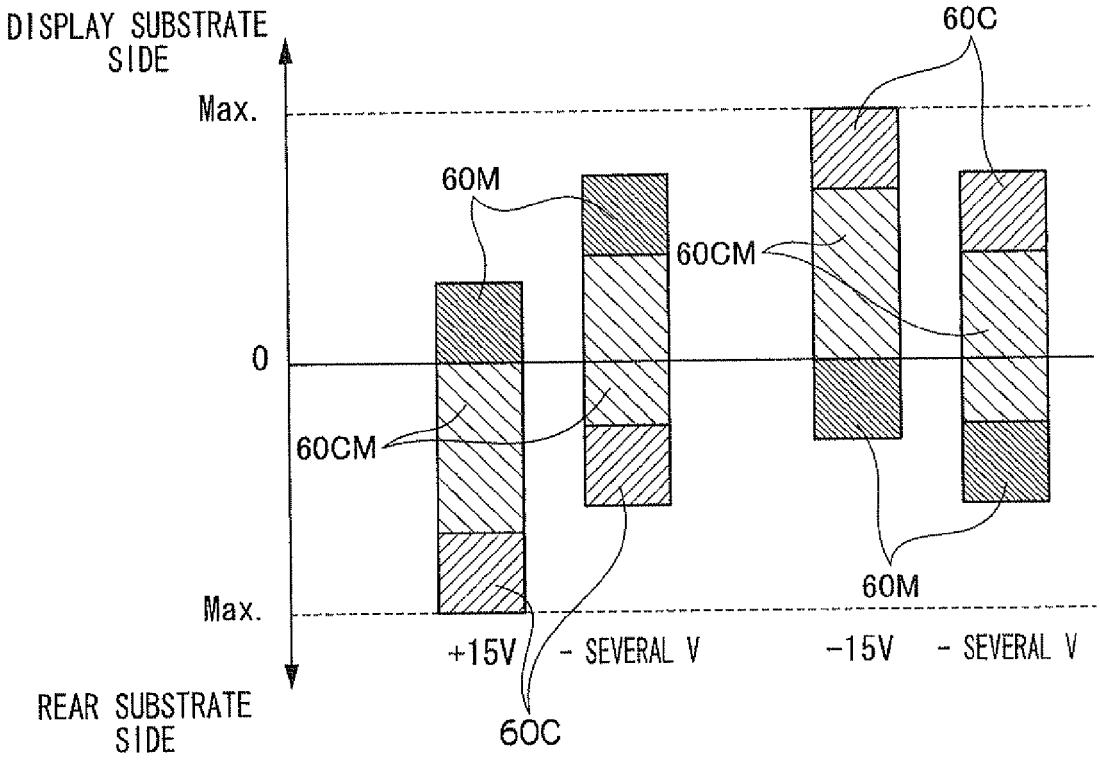
FIG. 6 is a drawing for explaining concrete examples of voltage application when tonally displaying blue.

FIG. 6 shows examples of voltage application when carrying out tonal display of blue color in which the ratios of the particle amount of the cyan particles C and the particle amount of the magenta particles M differs.

For example, when displaying blue by 80% of all of the magenta particles M and 50% of all of the cyan particles C, first, magenta particles M of an amount that is the difference between the magenta particles M and the cyan particles C, i.e., 80%−50%=30% of the magenta particles M, are moved toward the display substrate 1 side. Namely, the particles, whose needed particle amount is greater, are moved toward the display substrate side in a particle amount that is the difference with the amount of the particles whose needed particle amount is the smaller.

Concretely, as shown in FIG. 6, first, the aggregates CM are formed in the same way as has been described heretofore. Thereafter, voltage of +15 V (voltage corresponding to a third potential difference), that is from +V1 to +V2, is applied to the front electrode 3. Due thereto, 30% of all of the magenta particles M dissociate from the aggregates CM and move to the display substrate 1 side. Further, the aggregates CM, in which are aggregated the remaining 70% of the magenta particles M and 70% of all of the cyan particles C, move to the rear substrate 2 side, and the remaining approximately 30% of the cyan particles C dissociates from the aggregates CM and moves to the rear substrate 2 side.

Next, of the aggregates CM in which 70% of the magenta particles M and 70% of the cyan particles C are aggregated, the aggregates CM, in which 50% of the magenta particles M and 50% of the cyan particles C are aggregated, are moved toward the display substrate 1 side.

Concretely, as shown in FIG. 6, voltage (voltage corresponding to a fourth potential difference) of several V (e.g., −6 V), that is voltage from −Vg2 to −Vg1 and that is for moving 50% of the aggregates CM toward the display substrate 1 side, is applied to the front electrode 3. Due thereto, the aggregates CM, in which 50% of the magenta particles M and 50% of the cyan particles C are aggregated, are moved toward the display substrate 1 side. Therefore, blue color is displayed by 80% of the magenta particles M, that includes the 30% of the magenta particles M that had moved toward the display substrate 1 side previously, and 50% of the cyan particles C.

Similarly, for example, when displaying blue by 99% of all of the magenta particles M and 10% of all of the cyan particles C, first, 89% of the magenta particles M, which 89% is the difference between the magenta particles M and the cyan particles C, may be moved toward the display substrate 1 side, and thereafter, the aggregates CM, in which 10% of the magenta particles M and 10% of the cyan particles C are aggregated, may be moved to the display substrate 1 side.

Next, a case in which blue is displayed by 80% of all of the cyan particles C and 50% of all of the magenta particles M for example is described.

In this case, first, cyan particles C of an amount that is the difference between the cyan particles C and the magenta particles M, i.e., 80%-50%=30% of the cyan particles C, are moved toward the display substrate 1 side.

Concretely, as shown in FIG. 6, voltage of −15 V (voltage corresponding to the third potential difference), that is from −V2 to −V1, is applied to the front electrode 3. Due thereto, 30% of all of the cyan particles C dissociate from the aggregates CM and move to the display substrate 1 side. The aggregates CM, in which are aggregated the remaining 70% of the magenta particles M and 70% of all of the cyan particles C, move to the display substrate 1 side. Further, the remaining 30% of the magenta particles M dissociates from the aggregates CM and moves to the rear substrate 2 side.

Next, of the aggregates CM in which 70% of the magenta particles and 70% of the cyan particles C are aggregated, the aggregates CM, in which 20% of the magenta particles and 20% of the cyan particles C are aggregated, are moved toward the rear substrate 2 side.

Concretely, as shown in FIG. 6, voltage (voltage corresponding to a fifth potential difference) of +several V (e.g., +4 V), that is voltage from +Vg1 to +Vg2 and that is for moving 20% of the aggregates CM toward the display substrate 1 side, is applied to the front electrode 3. Due thereto, the aggregates CM, in which 20% of the magenta particles M and 20% of the cyan particles C are aggregated, move toward the rear substrate 2 side. Therefore, blue color is displayed by 80% of the cyan particles C, that includes the 30% of the cyan particles C that had moved toward the display substrate 1 side previously, and 50% of the magenta particles M.

Similarly, for example, when displaying blue by 20% of all of the cyan particles C and 5% of all of the magenta particles M, first, 15% of the cyan particles, which 15% is the difference between the cyan particles C and the magenta particles M, and the aggregates CM in which are aggregated 85% of the magenta particles and 85% of the cyan particles C, may be moved toward the display substrate 1 side, and thereafter, the aggregates CM, in which the surplus 80% of the magenta particles M and 80% of the cyan particles C are aggregated, may be moved toward the rear substrate 2 side.

Second Exemplary Embodiment

Next, description is given of a display medium that uses three types of electrophoretic particles and has a third particle group, that at least migrates independently in accordance with the voltage applied between the pair of electrodes and whose aggregating force with respect to the first particle group and the second particle group is different than the aggregating force of the aggregates of the first particle group and the second particle group.

In the display medium relating to the present exemplary embodiment, positive-charge cyan particles C, negative-charge magenta particles M, and negative-charge yellow particles Y, that have larger diameters than the cyan particles C and the magenta particles M, are dispersed in the dispersion medium 6 as electrophoretic particles.

The cyan particle C group and the magenta particle M group aggregate together and form aggregates. The yellow particle Y group either does not have an aggregating ability with respect to the other types of particle groups, or has an extremely small aggregating force with respect to the cyan particle C group and the magenta particle M group respectively as compared with the aggregating force between the cyan particle C group and the magenta particle M group, and does not form aggregates with the particle C, M groups of the other types.

It suffices for the sizes of the respective particles to be such that the cyan particles C and the magenta particles M can respectively pass through between the particles of the yellow particle Y group. The large-diameter yellow particles Y have a large charge amount as compared with the cyan particles C and the magenta particles M that have small diameters, and therefore, the responsiveness of the yellow particles Y with respect to voltage applied between the electrodes is higher than those of the cyan particles C and the magenta particles M. From standpoints such as the responsiveness of the yellow particles Y with respect to voltage (potential) is high as compared with those of the cyan particles C and the magenta particles M, and the cyan particles C and the magenta particle M can easily slip through between the yellow particles Y, and the like, it is desirable for the particle diameter of the yellow particles Y to be greater than or equal to 10 times the respective particle diameters of the cyan particles C, the magenta particles M.

Note that, in the present specification, the particle diameter is the volume average particle diameter of the particles, and is a value measured by the HORIBA LA-300 (a laser light scattering/diffracting type particle size measuring device).

Figure 7:
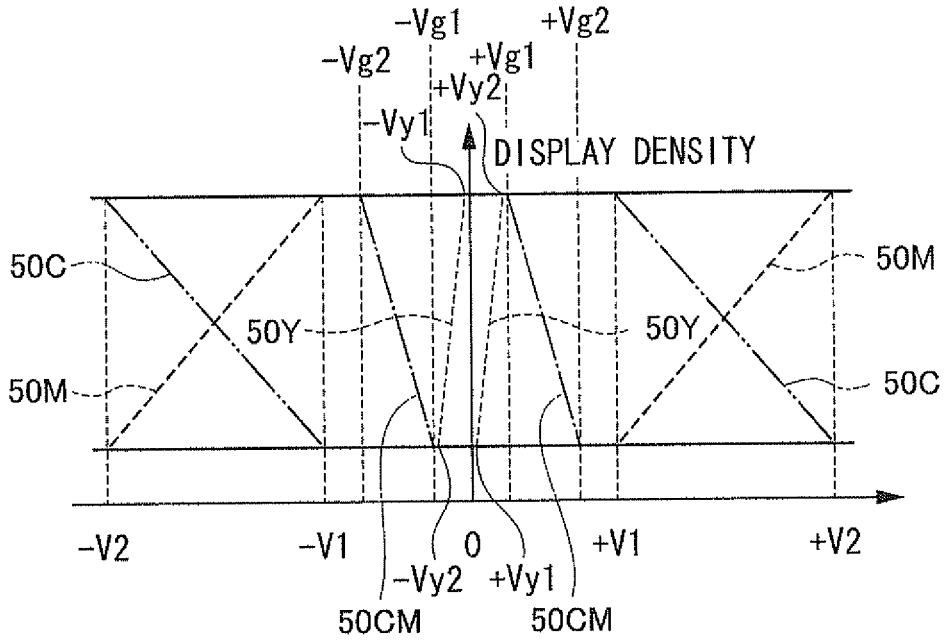
FIG. 7 is a drawing showing the voltage application characteristics of respective migrating particles relating to a second exemplary embodiment.

FIG. 7 shows the characteristics of applied voltages that are needed in order to move the cyan particles C, the magenta particles M, the aggregates CM of the cyan particles C and the magenta particles M, and the yellow particles Y to the display substrate 1 side and the rear substrate 2 side in the display device 100 relating to the present exemplary embodiment. In FIG. 7, the applied voltage characteristic of the cyan particles C is expressed as the characteristic 50C, the applied voltage characteristic of the magenta particles M is expressed as the characteristic 50M, the applied voltage characteristic of the aggregates CM is expressed as the characteristic 50CM, and the applied voltage characteristic of the yellow particles Y is expressed as characteristic 50Y. As shown in FIG. 7, the applied voltage characteristics of the cyan particles C, the magenta particles M, and the aggregates CM are the same as in FIG. 3.

FIG. 7 shows the relationships between pulse voltage that is applied to the front electrode 3 with the rear electrode 4 being ground (0 V), and the display densities by the respective particle groups.

As shown in FIG. 7, the movement starting voltage (threshold voltage) at which the yellow particles Y at the rear substrate 2 side start to move toward the display substrate 1 side is +Vy1, and the movement ending voltage at which the yellow particles Y at the rear substrate 2 side finish moving toward the display substrate 1 side is +Vy2.

The movement starting voltage (threshold voltage) at which the yellow particles Y at the display substrate 1 side start to move toward the rear substrate 2 side is −Vy1, and the movement ending voltage at which the yellow particles Y at the display substrate 1 side finish moving toward the rear substrate 2 side is −Vy2. Note that voltages in the range of |Vy1| to |Vy2| are voltages corresponding to a sixth potential difference.

—Cyan Display—

Figure 8:
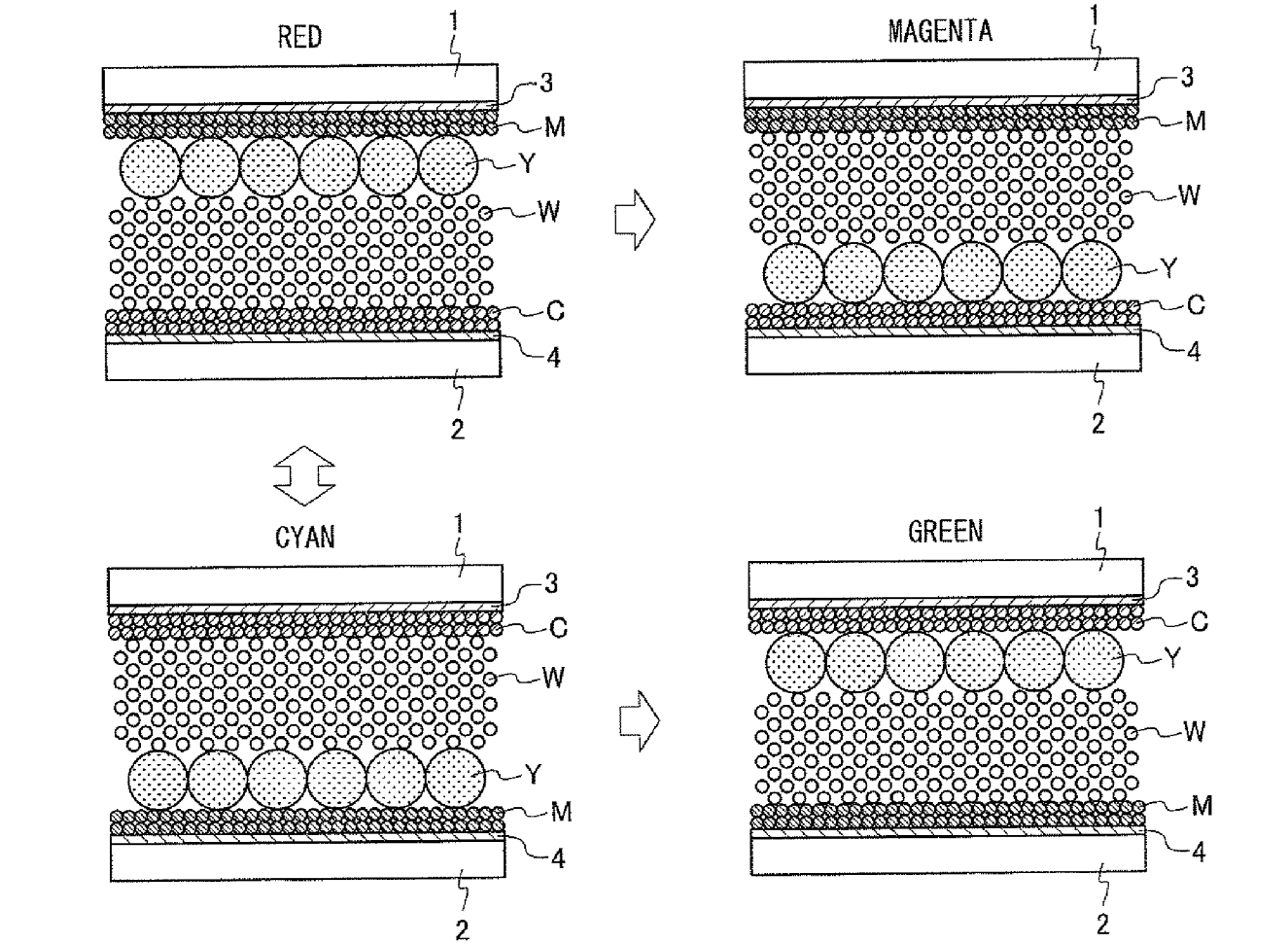
FIG. 8 is a drawing for explaining displayed states of respective colors in a display device relating to the second exemplary embodiment.

The voltage that is applied when carrying out cyan display is similar to that of the first exemplary embodiment. Namely, by applying voltage of −V2 to the front electrode 3, the cyan particles C are pulled to the display substrate 1 side, and the magenta particles M and the yellow particles Y are pulled to the rear substrate 2 side, and cyan display is performed as shown in FIG. 8.

—Red Display—

When changing from cyan display to red display, in the state in which cyan is displayed, voltage of +Vy2 is applied to the front electrode 3. Due thereto, only the yellow particles Y move toward the display substrate 1 side, and red display is performed as shown in FIG. 8.

—Magenta Display—

When changing from red display to magenta display, in the state in which red is displayed, voltage of −Vy2 is applied to the front electrode 3. Due thereto, only the yellow particles Y move toward the rear substrate 2 side, and magenta display is performed as shown in FIG. 8.

—Green Display—

When changing from cyan display to green display, in the state in which cyan is displayed, voltage of +Vy2 is applied to the front electrode 3. Due thereto, only the yellow particles Y move toward the display substrate 1 side, and green display is performed as shown in FIG. 8.

—Yellow Display—

Figure 9:
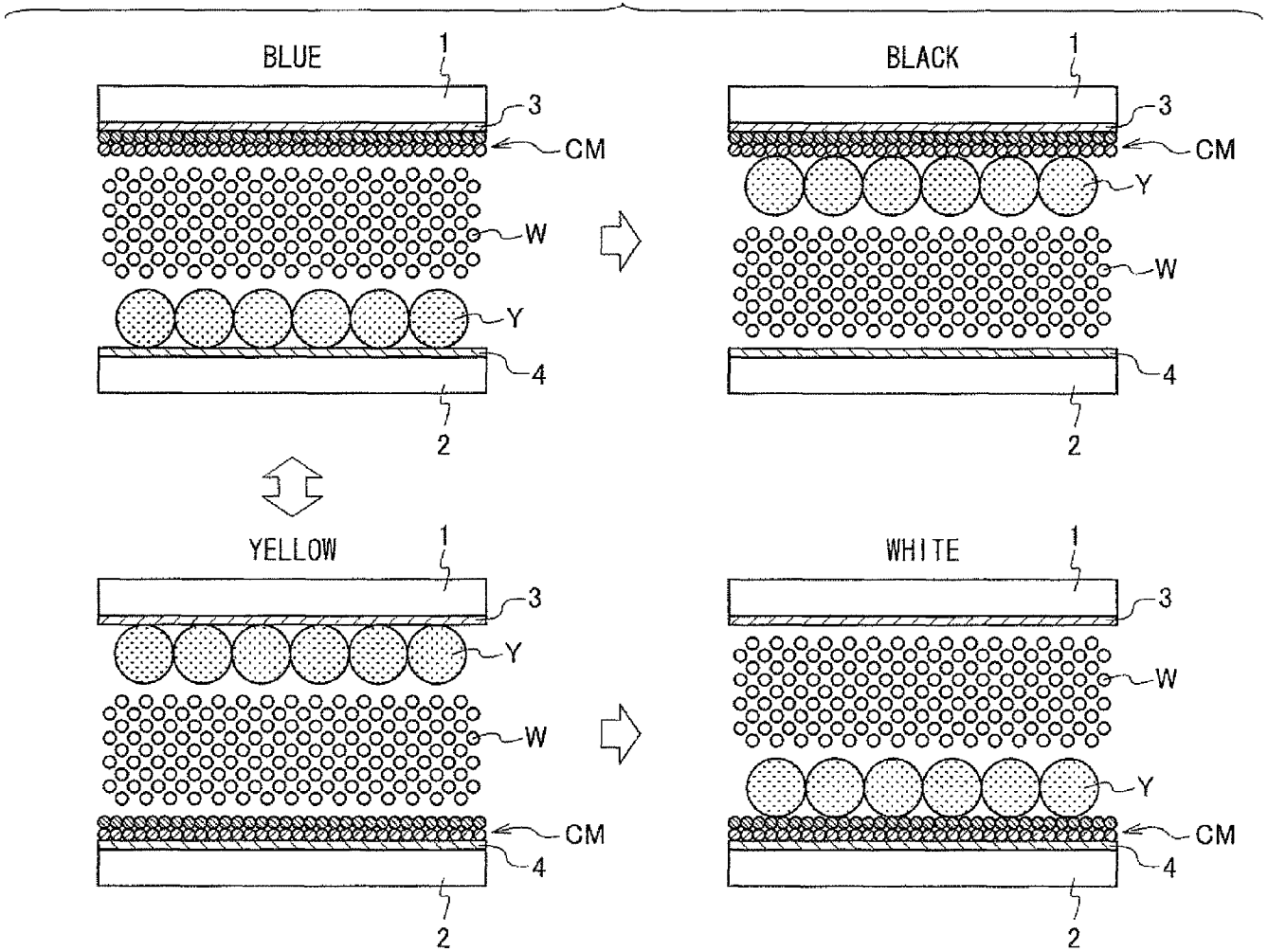
FIG. 9 is a drawing for explaining displayed states of respective colors in the display device relating to the second exemplary embodiment.

When yellow display is to be carried out, first, in the same way as in the first exemplary embodiment, the aggregates CM are once formed as shown in (3) of FIG. 2. Next, in this state, voltage of +Vg2 is applied to the front electrode 3. Due thereto, the yellow particles Y move toward the display substrate 1 side, the aggregates CM move toward the rear substrate 2 side, and yellow display is performed as shown in FIG. 9.

—Blue Display—

When changing from yellow display to blue display, in the state in which yellow is displayed, voltage of −Vg2 is applied to the front electrode 3. Due thereto, from the state of yellow display, the yellow particles Y move toward the rear substrate 2 side, the aggregates CM move toward the display substrate 1 side, and blue display is performed as shown in FIG. 9.

—Black Display—

When changing from blue display to black display, in the state in which blue is displayed, voltage of +Vy2 is applied to the front electrode 3. Due thereto, from the state of blue display, the yellow particles Y move toward the display substrate 1 side, and black display is performed as shown in FIG. 9.

—White Display—

When changing from yellow display to white display, in the state in which yellow is displayed, voltage of −Vy2 is applied to the front electrode 3. Due thereto, from the state of yellow display, the yellow particles Y move toward the rear substrate 2 side, and white display is performed as shown in FIG. 9.

—Yellow Gradation Display—

Figure 10:
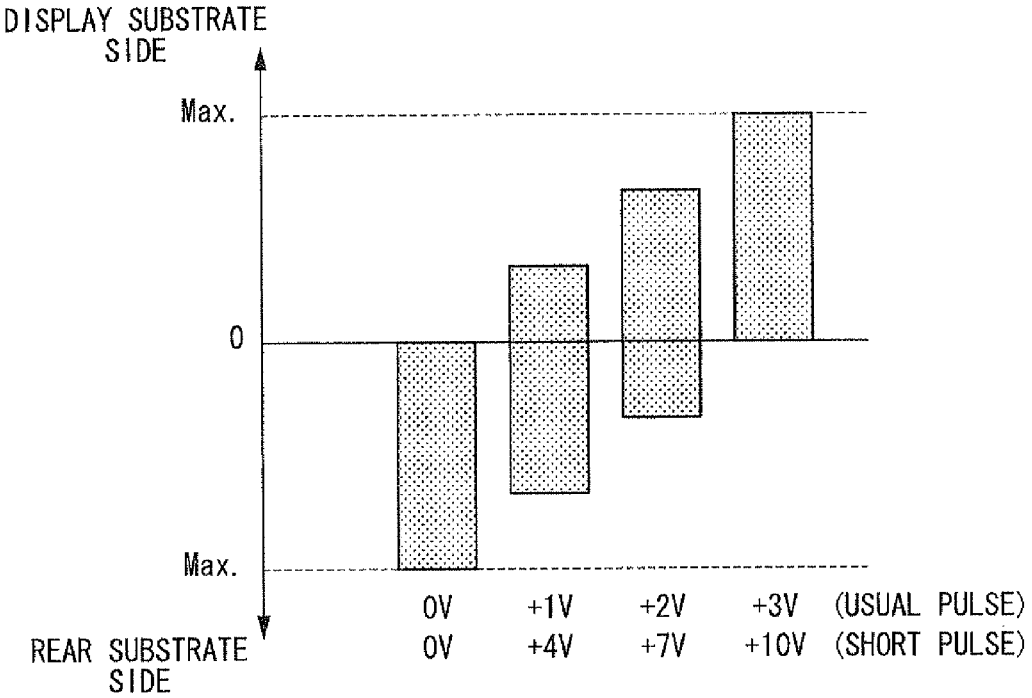
FIG. 10 is a drawing for explaining concrete examples of voltage application when gradation-displaying yellow.

FIG. 10 shows amounts of the yellow particles Y that move toward the display substrate 1 side and the rear substrate 2 side when, in the state in which the aggregates CM are formed, voltages of +1 V, +2 V, +3 V that are voltages that are from +Vy1 to +Vy2 are applied to the front electrode 3 in a usual pulse (e.g., 1 second), and when, in the state in which the aggregates CM are formed, voltages of +4 V, +7 V, +10 V that are voltages that are from +Vy1 to +Vy2 are applied to the front electrode 3 in a short pulse (e.g., 0.1 seconds).

As shown in FIG. 10, the amount of the yellow particles Y that move toward the display substrate 1 side varies in accordance with the magnitude of the voltage that is applied to the front electrode 3.

Accordingly, when yellow is to be gradation-displayed, it suffices to, in the state of white display, apply voltage within the range of from +Vy1 to +Vy2 to the front electrode 3 in accordance with the desired gradation.

Further, there are also cases in which the aggregates CM are larger than the yellow particles Y, and the responsiveness is higher and the threshold value is lower than those of the yellow particles Y. In such a case, it suffices to first move the necessary amount of the yellow particles Y, and to move the aggregates CM thereafter.

Figure 11:
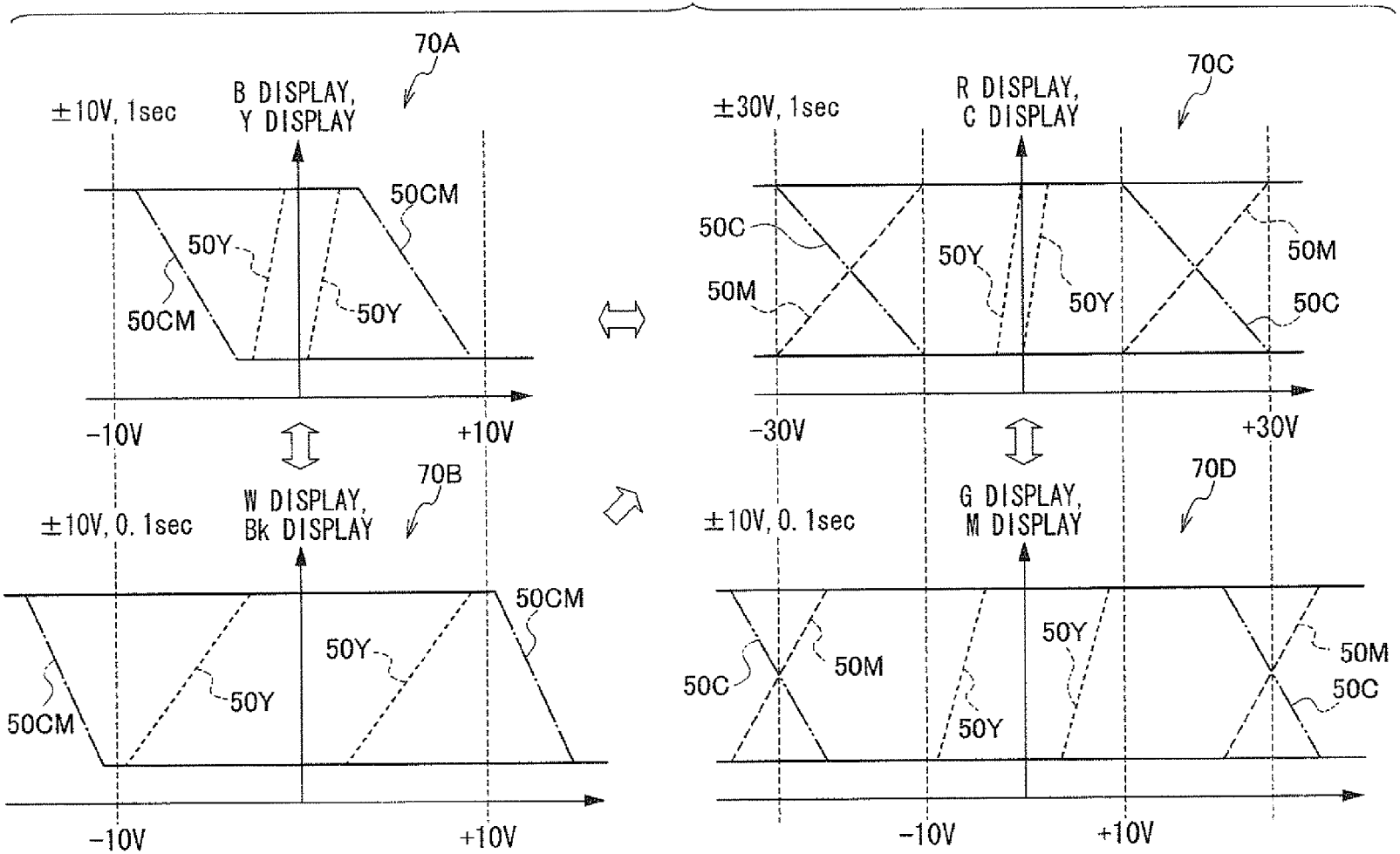
FIG. 11 is a drawing for explaining cases in which yellow particles are driven at a short pulse.

Note that, as shown by voltage application characteristic 70A of FIG. 11, when, in the state in which the aggregates CM are formed, voltage of +10 V is applied to the front electrode 3 in a usual pulse (e.g., 1 second), the aggregates CM move to the rear substrate 2 side and the yellow particles Y move toward the display substrate 1 side, and therefore, yellow display is performed. Further, when, in the state in which the aggregates CM are formed, voltage of −10 V is applied to the front electrode 3 in a usual pulse, the aggregates CM move to the display substrate 1 side and the yellow particles Y move toward the rear substrate 2 side, and therefore, blue display is performed.

When carrying out white display from the state of yellow display, as described above, it suffices to apply voltage of +Vy2 (e.g., +3 V) in a usual pulse. However, because the responsiveness of the yellow particles Y is higher than those of other particles and the threshold voltage is lower, voltage that is greater than or equal to +Vy2 (voltage corresponding to a seventh potential difference, e.g., voltage of +10 V) may be applied in a short pulse (a third time, e.g., 0.1 seconds). For example, as shown by voltage application characteristic 70B of FIG. 11, when, in the state of yellow display, voltage of +10 V is applied to the front electrode 3 in a short pulse, only the yellow particles Y move to the display substrate 1 side, and the aggregates CM remain as are at the display substrate 1 side and do not move to the rear substrate 2 side. Namely, when a short pulse of voltage is applied, the threshold voltage is higher, but the responsiveness also is higher. The same holds for the case of carrying out black display from the state of blue display.

Further, as shown by voltage application characteristic 70C of FIG. 11, when voltage of +30 V is applied to the front electrode 3 in a usual pulse (e.g., 1 second), the magenta particles M and the yellow particles Y move to the display substrate 1 side and the cyan particles C move toward the rear substrate 2 side, and therefore, red display is performed. Further, when voltage of −30 V is applied to the front electrode 3 in a usual pulse, the cyan particles C move to the display substrate 1 side and the magenta particles M and the yellow particles Y move toward the rear substrate 2 side, and therefore, cyan display is performed.

When carrying out magenta display from the state of cyan display, as described above, it suffices to apply voltage of +Vy2 (e.g., +3 V) in a usual pulse. However, in this case as well, voltage, that is greater than or equal to −Vy2 (e.g., voltage of +10 V) may be applied in a short pulse (e.g., 0.1 seconds). For example, as shown by voltage application characteristic 70D of FIG. 11, when, from the state of cyan display, voltage of +10 V is applied to the front electrode 3 in a short pulse, only the yellow particles Y move to the display substrate 1 side, and the aggregates CM remain at the display substrate 1 side and do not move to the rear substrate 2 side. The same holds for the case of carrying out magenta display from the state of red display.

In this way, with regard to the yellow particles Y, the responsiveness may be increased by applying, in a short pulse, a voltage that is high voltage (±10 V) whose absolute value is higher than a low voltage, instead of applying a voltage that is the low voltage (e.g., ±3 V) in a usual pulse.

As described above, display of eight colors is realized by using, as three types of electrophoretic particles, two types of small-diameter particles that form aggregates and one type of large-diameter particles whose responsiveness is higher than the small-diameter particles and that does not aggregate with other types of particles, and, by utilizing the differences in the aggregating forces and the differences in responsivenesses of these particles, controlling the intensity and the time of the voltage applied between the electrodes.

The electrophoretic particles and the dispersion medium that are used in the present exemplary embodiment are described more concretely hereinafter.

The electrophoretic particles (charged particles) that are used in the present exemplary embodiment are structured to include colored particles that contain a colorant and a polymer having a charging group, and a reactive silicone polymer or a reactive long-chain alkyl polymer that is bound to or coated on the surfaces of the colored particles. Namely, the charged particles relating to the present exemplary embodiment are (1) charged particles in which a reactive silicone polymer is bound to or coated on the surfaces of the colored particles, or (2) charged particles in which a reactive long-chain alkyl polymer is bound to or coated on the surfaces of the colored particles. Note that a medium, that is described as the first solvent that is used in the method of producing particles described below, is used as the dispersion medium.

The charged particles relating to the present exemplary embodiment are particles that move in accordance with an electric field, and that have charge characteristics in a state of being dispersed in a dispersion medium, and that move within the dispersion medium in accordance with the electric field that is formed. Further, by being structured as described above, the charged particles (the dispersion liquid for displaying) relating to the present exemplary embodiment are particles that have stable dispersibility and charge characteristics. The charge characteristic expresses the charge polarity and the charge amount of the particles. In the present exemplary embodiment, fluctuations in the charge polarity and the charge amount are suppressed and stabilized.

Because the charged particles relating to the present exemplary embodiment have the above-described characteristics, stable dispersibility and charge characteristics are maintained even in a system in which plural types of charged particles having different charge characteristics are mixed together. Plural types of charged particles having different charge characteristics are obtained by, for example, changing the charging group of the polymer that has the charging group as described below.

The colored particles include a polymer having a charging group, and a colorant, and, as needed, other compounded materials.

The polymer that has the charging group is a polymer that has a cationic group or an anionic group as the charging group. Examples of the cationic group that serves as the charging group include amino groups and quaternary ammonium groups (including salts of these groups). A positive charge polarity is imparted to the particles by this cationic group. Examples of the anionic group that serves as the charging group include phenol groups, carboxyl groups, carboxylate groups, sulfonic acid groups, sulfonate groups, phosphoric acid groups, phosphate groups, and tetraphenylboron groups (including salts of these groups). A negative charge polarity is imparted to the particles by this anionic group.

The polymer that has the charging group may be, for example, a homopolymer of a monomer having a charging group, or a copolymer of a monomer having a charging group and another monomer (a monomer that does not have a charging group).

Examples of the monomer that has the charging group include monomers having a cationic group (hereinafter called cationic monomers) and monomers having an anionic group (hereinafter called anionic monomers).

Examples of the cationic monomer include:

a (meth)acrylic ester having an aliphatic amino group such as N,N-dimethylaminoethyl(meth)acrylate, N,N-diethylaminoethyl(meth)acrylate, N,N-dibutylaminoethyl(meth)acrylate, N,N-hydroxyethylaminoethyl(meth)acrylate, N-ethylaminoethyl(meth)acrylate, N-octyl-N-ethylaminoethyl (meth)acrylate, or N,N-dihexylaminoethyl(meth)acrylate;

an aromatic substituted ethylenic monomer having a nitrogen-containing group such as dimethylamino styrene, diethylamine styrene, dimethylamino methylstyrene, or dioctylamino styrene;

a nitrogen-containing vinylether monomer such as vinyl-N-ethyl-N-phenylaminoethyl ether, vinyl-N-butyl-N-phenylaminoethyl ether, triethanolamine divinyl ether, vinyldiphenylaminoethyl ether, N-vinylhydroxyethyl benzamide, or m-aminophenylvinyl ether;

a pyrrole such as N-vinylpyrrole or vinylamine;

a pyrroline such as N-vinyl-2-pyrroline or N-vinyl-3-pyrroline;

a pyrrolidine such as N-vinylpyrrolidine, vinylpyrrolidine aminoether, or N-vinyl-2-pyrrolidone;

an imidazole such as N-vinyl-2-methylimidazole;

an imidazoline such as N-vinylimidazoline;

an indole such as N-vinyl indole;

an indoline such as N-vinyl indoline;

a carbazole such as N-vinylcarbazole or 3,6-dibrome-N-vinylcarbazole;

a pyridine such as 2-vinylpyridine, 4-vinylpyridine, or 2-methyl-5-vinylpyridine;

a piperidine such as (meth)acrylpiperidine, N-vinylpiperidone, or N-vinylpiperazine;

a quinoline such as 2-vinylquinoline or 4-vinylquinoline;

a pyrazole such as N-vinylpyrazole or N-vinylpyrazoline;

an oxazole such as 2-vinyloxazole; and an oxazine such as 4-vinyloxazine or morpholinoethyl (meth)acrylate.

As cationic monomers that are particularly preferable from the standpoint of broad usability, (meth)acrylates having an aliphatic amino group, such as N,N-dimethylaminoethyl (meth)acrylate, N,N-diethylaminoethyl(meth)acrylate, and the like are preferable. In particular, using such a compound in a structure that changes the compound into a quaternary ammonium salt before polymerization or after polymerization is preferable. The process of changing the compound into a quaternary ammonium salt is achieved by reacting the compound with an alkyl halide or toluenesulfonates.

The following are examples of the anionic monomer.

The anion monomer may include carboxylic monomers such as: (meth)acrylic acid, methacrylic acid, crotonic acid, itaconic acid, maleic acid, fumaric acid, citraconic acid, or an anhydride or monoalkyl ester of any of these acids, or a vinyl ether having a carboxyl group such as carboxyethylvinyl ether or carboxypropylvinyl ether.

The anion monomer may include sulfuric monomers such as: styrene sulfonic acid, 2-acrylamide-2-methylpropane sulfonic acid, 3-sulfopropyl(meth)acrylic acid ester, bis-(3-sulfopropyl)-itaconic acid ester or the like, or a salt of any of these compounds, and a sulfuric acid monoester of 2-hydroxyethyl(meth)acrylic acid or a salt thereof.

The anion monomer may include phosphoric monomers such as: vinylphosphonic acid, vinylphosphate, acid phosphoxyethyl(meth)acrylate, acid phosphoxypropyl (meth) acrylate, bis(methacryloxyethyl)phosphate, diphenyl-2-methacryloxyethyl phosphate, diphenyl-2-acryloyloxyethyl phosphate, dibutyl-2-methacryloyloxyethyl phosphate, dibutyl-2-acryloyloxyethyl phosphate, or dioctyl-2-(meth)acryloyloxyethyl phosphate.

Preferable anionic monomers are those having (meth) acrylic acid or sulfonic acid, and more preferable are those having a structure of an ammonium salt before polymerization or after polymerization. The ammonium salt is produced by reacting the anionic monomer with a tertiary amine or a quaternary ammonium hydroxide.

Nonionic monomers are examples of other monomers. Examples thereof include (meth)acrylonitrile, alkyl(meth) acrylate, (meth)acrylamide, ethylene, propylene, butadiene, isoprene, isobutylene, N-dialkyl substituted (meth)acrylamide, styrene, vinyl carbazole, styrene derivatives, polyethylene glycolmono(meth)acrylate, vinyl chloride, vinylidene chloride, vinyl pyrrolidone, hydroxyethyl(meth)acrylate, hydroxybutyl(meth)acrylate, and the like.

The copolymerization ratio of the monomer having the charging group and the other monomer is appropriately changed in accordance with the desired charge amount of the particles. Usually, the copolymerization ratio of the monomer having the charging group and the other monomer is selected in the range of from 1:100 to 100:0 as a mol ratio.

The weight average molecular weight of the polymer having the charging group is desirably from 1000 to 1,000,000, and more desirable from 10,000 to 200,000.

Next, colorants are described. For the colorant, organic or inorganic pigments or oil-soluble dye may be used. Examples thereof may be known colorants that include: magnetic powders such as magnetite or ferrite; carbon black; titanium oxide; magnesium oxide; zinc oxide; phthalocyanine copper-based cyan colorants; azo-based yellow colorants; azo-based magenta colorants; quinacridone-based magenta colorants; red colorants; green colorants; and blue colorants, Specifically, typical examples thereof include aniline blue, chalcoil blue, chrome yellow, ultramarine blue, Dupont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment blue 15:1, and C.I. pigment blue 15:3.

The compounded amount of the colorant is desirably from 10% by mass to 99% by mass with respect to the polymer having the charging group, and more desirably from 30% by mass to 99% by mass.

The other compounded materials are described next. A charge control agent and a magnetic material are examples of the other compounded materials.

The charge control agent may be a known charge control agent used in electrophotographic toner materials. Examples thereof include: quaternary ammonium salts such as cetylpyridyl chloride, BONTRON P-51, BONTRON P-53, BONTRON E-84 and BONTRON E-81 (manufactured by ORIENT CHEMICAL INDUSTRIES, LTD.); salicylic acid metal complexes; phenol condensates; tetraphenyl compounds; metal oxide particles; and metal oxide particles whose surface has been treated with various kinds of coupling agents.

The magnetic material may be an inorganic or organic magnetic material, which may have been color-coated (colored by coating) as required. Transparent magnetic materials, particularly transparent organic magnetic materials, are more preferable because they do not impede coloration by a colored pigment and have smaller specific gravities than those of inorganic magnetic materials.

Examples of the colored magnetic material include a small-diameter colored magnetic powder described in JP-A No. 2003-131420. The colored magnetic material may have a magnetic particle as a core and a colored layer disposed on the surface of the magnetic particle. The colored layer may be, for example, a layer containing a pigment or the like that colors the particle such that the particle becomes opaque. The colored layer may be an optical interference thin film. The optical interference thin film is obtained by forming a colorless material, such as $SiO_2$ or $TiO_2$, into a thin film having a thickness equivalent to the wavelength of light, so that the thin film selectively reflects lights of particular wavelengths by optical interference in the thin film.

The reactive silicone polymer and the reactive long-chain alkyl polymer that are bonded to or coated on the surfaces of the colored particles are described next.

The reactive silicone polymer and the reactive long-chain alkyl polymer are reactive dispersing agents, and examples thereof are as follows.

Copolymers that are formed from the following respective components (A. a silicone chain component, B. a reactive component, C. other copolymer components) are examples of the reactive silicone polymer.

A. Silicone Chain Component

Examples of the silicone chain component include a dimethylsilicone monomer having a (meth)acrylate group at one terminal thereof (for example, SILAPLANE FM-0711, FM-0721, FM-0725 or the like manufactured by CHISSO CORP., or X-22-174DX, X-22-2426, X-22-2475 or the like manufactured by SHIN-ETSU SILICONE CORP.).

B. Reactive Component

Examples of the reactive component include glycidyl (meth)acrylate and an isocyanate monomer (KARENZ AOI or KARENZ MOI, manufactured by SHOWA DENKO K. K.).

C. Other Copolymer Components

Examples of other copolymer components include an alkyl (meth)acrylate such as methyl(meth)acrylate, ethyl(meth) acrylate, propyl(meth)acrylate, or butyl(meth)acrylate; hydroxyethyl(meth)acrylate; hydroxybutyl(meth)acrylate; a monomer having an ethylene oxide unit such as a (meth) acrylate of alkyloxy oligoethyleneglycol (for example, tetraethyleneglycol monomethylether(meth)acrylate; polyethylene glycol having (meth)acrylate at one terminal thereof; (meth)acrylic acid; maleic acid; and N,N-dialkylamino (meth)acrylate.

Among the above, the component A and the component B are essential, and the components C may be optionally copolymerized.

When preparing charged particles in which particles of different types may independently migrate or form aggregates and then migrate, the copolymerization ratio of the three components is preferably adjusted such that the amount of the silicone chain component A is preferably 50% by weight or more, and more preferably 80% by weight or more, with respect to the weight of the copolymer. When the proportion of non-silicone chain components is more than 20% by weight, surface activation ability may decrease, whereby the diameter of the particles formed may increase, aggregation may easily occur between the formed particles, and independent movement of different types of particles may be inhibited. The amount of the reactive component B may be in the range of from 0.1% by weight to 10% by weight with respect to the weight of the copolymer. When the amount of the reactive component B is more than 10% by weight, the reactive group may remain in the electrophoretic particles and aggregation may be easily occur. When the amount of the reactive component B is less than 0.1% by weight, the bonding of the reactive silicone polymer compound to the particle surface may be incomplete.

Besides the above copolymer, the reactive silicone polymer compound may also be a silicone compound having an epoxy group at one terminal thereof, for example, X-22-173DX manufactured by SHIN-ETSU SILICONE CORP.

Among these components, a copolymer formed from at least two components, including a dimethylsilicone monomer having a (meth)acrylate group at one terminal thereof (a silicone compound such as SILAPLANE FM-0711, FM-0721, FM-0725 or the like manufactured by CHISSO CORP., or X-22-174DX, X-22-2426, X-22-2475 or the like manufactured by SHIN-ETSU SILICONE CORP.) and a glycidyl(meth)acrylate monomer or isocyanate monomer (KARENZ AOI or KARENZ MOI, manufactured by SHOWA DENKO K. K.) is preferable since this copolymer may have excellent reactivity and surfactant activating ability.

The weight average molecular weight of the reactive silicone polymer compound is preferably from 1,000 to 1,000,000 and more preferably from 10,000 to 1,000,000.

The reactive long-chain alkyl polymer may have a similar structure to that of the above-described silicone copolymer, except that a long-chain alkyl(meth)acrylate is used as a long-chain alkyl component A' in place of the silicone chain component A. The long-chain alkyl(meth)acrylate may include those having an alkyl chain with 4 or more carbon atoms, and specific examples thereof include butyl(meth) acrylate, hexyl(meth)acrylate, 2-ethylhexyl(meth)acrylate, dodecyl(meth)acrylate, and stearyl(meth)acrylate. Among these, a copolymer may include at least two components, one of which is selected from long-chain alkyl(meth)acrylates and the other of which is selected from glycidyl (meth)acrylate and isocyanate monomers (such as KARENZ AOI and KARENZ MOI manufactured by SHOWA DENKO K.K.), from the viewpoints of excellent reactivity and excellent surfactant activity. The formulation ratio of the components A', B, and C in a copolymer may be selected from the similar range as for the reactive silicone polymer.

The reactive "long-chain" alkyl polymer herein refers, for example, to a polymer having, as a side chain of an alkyl chain having from about 4 to about 30 carbon atoms.

The weight-average molecular weight of the reactive long-chain alkyl polymer is desirably from 1,000 to 1,000,000, and more desirably from 10,000 to 1,000,000.

The reactive silicone polymer or the reactive long-chain alkyl polymer is bound to the surfaces of colored particles, or the surfaces of colored particles are coated by any of these polymers. The term "bound" herein means that a reactive group of the polymer is bound to a functional group (which may also serve as the charging group) present on the surface of a colored particle. The term "coated" herein means that the reactive polymer forms a layer on the surface of the colored particle by reacting, e.g., polymerizing, the reactive groups of the reactive polymer with the functional groups present on the surface of a colored particle or with a chemical substance added separately to the system, and thereby coating the surface with the layer.

Examples of a method for selectively performing the binding or coating include followings. When performing the binding, the reactive silicone polymer or reactive long-chain alkyl polymer having a reactive group that aggressively binds to the functional group (charging group) as described above is selected (for example, an acid group, acid base, alcoholate group, or phenolate group may be selected as the functional group present on the particle, and an epoxy group or isocyanate group may be selected as the reactive group). When performing the coating, the reactive silicone polymer or reactive long-chain alkyl polymer having functional groups that may bind to the functional group (charging group) of one other may be selected as a catalyst (for example, an amino group or ammonium group may be selected as the functional group (charging group), and an epoxy group may be selected as the reactive group).

The method of binding or coating the reactive silicon polymer or reactive long-chain alkyl polymer onto the surfaces of colored particles may be carried out by heating or the like. From the viewpoint of dispersibility, the amount of the reactive silicone polymer or reactive long-chain alkyl polymer for binding or coating is preferably in the range of from 2% by weight to 200% by weight with respect to the particles. When the amount is less than 2% by weight, dispersibility of the particles may be deteriorated, while when the amount is more than 200% by weight, the charge amount of the particles may decrease.

The binding and/or coating amount may be determined in the following manner. One method is to subjecting the prepared particles to centrifugal sedimentation, and measuring the weight of the prepared particles to determine the increment of the weight with respect to the amount (weight) of the particle material. Other method may be calculating the binding and/or coating amount by analyzing the composition of the particles.

The method of producing the charged particles relating to the present exemplary embodiment is described next.

It is suitable for the method of producing the charged particles relating to the present exemplary embodiment to have: a process of stirring and emulsifying a mixed solution containing a polymer having a charging group, a colorant, a reactive silicone polymer or a reactive long-chain alkyl polymer, a first solvent, and a second solvent that is incompatible with respect to the first solvent, and has a lower boiling point than the first solvent, and that dissolves the polymer having the charging group; a process of removing the second solvent from the emulsified mixed solution, and generating colored particles that contain the colorant and the polymer having the charging group; and a process of reacting the reactive silicone polymer or the reactive long-chain alkyl polymer, and bonding it to or coating it on the surfaces of the colored particles. When the charged particles are produced by such drying-in-liquid method, charged particles having stable dispersibility and charge characteristics are obtained in particular.

In the present method, a dispersion medium that is used in a display medium may be used as the first solvent, so that it may directly form the charged particle dispersion liquid that contains the charged particles and the dispersion medium. Due thereto, in the method of producing charged particles relating to the present exemplary embodiment, the charged particle dispersion liquid that uses the first solvent as the dispersion medium is easily produced by the above-described processes, without going through washing and drying processes. Of course, washing the particles (removing of ionic impurities) and replacing the dispersion medium may be carried out appropriately in order to improve the electrical characteristics.

The method for producing charged particles according to the exemplary embodiment is not limited to the process described above. For example, the charged particles may be produced by forming colored particles a known method (such as coacervation method, dispersion polymerization method, or suspension polymerization method), and then dispersing the colored particles in a solvent including a reactive silicone polymer or a reactive long-chain alkyl polymer, causing reaction with the reactive silicone polymer or the reactive long-chain alkyl polymer, and bounding the polymer to or coating the polymer on the surfaces of the colored particles.

Details of the method of producing charged particles relating to the above-described exemplary embodiment are described hereinafter per process.

—Emulsification Process—

In the emulsification process, for example, two solutions, that is, i) a solution including a first solvent and a reactive silicone polymer or a reactive long-chain alkyl polymer and ii) a solution including a polymer having a charging group, a colorant, and a second solvent which is incompatible with the first solvent, has a boiling point lower than that of the first solvent, and dissolves the polymer having a charging group, are mixed and stirred to emulsify the materials. The mixed solutions to be emulsified may also include one or more materials other than the materials described above (e.g. a charge control agent, a pigment dispersant, or the like), if necessary.

In the emulsification process, the solution mixture is stirred whereby the low-boiling solution (including the second solvent) may emulsified by forming a disperse phase in forms of droplets in a continuous phase of the high-boiling solution (which includes the first solvent and the reactive polymer). The reactive silicon polymer or the reactive long-chain alkyl polymer may be dissolved in the continuous phase of the high-boiling solution, while the polymer having a charging group and the colorant may be dissolved or dispersed in the low-boiling solution.

In the emulsification process, the respective materials may be mixed one after another in the mixed solutions, but the process is not limited thereto. For example, a first mixed solution in which the polymer having a charging group, the colorant, and the second solvent are mixed, and a second mixed solution in which the first solvent and the reactive silicone polymer or the reactive long-chain alkyl polymer are mixed may be firstly prepared. Then, the first mixed solution may be dispersed in and mixed with the second mixed solution such that granular droplets of the first mixed solution are dispersed in the second mixed solution, and the solutions are emulsified. The second mixed solution may be prepared by adding monomers that constitute the reactive silicone polymer or the reactive long-chain alkyl polymer to the first solvent, and then polymerizing the monomers to produce the reactive silicone polymer or the reactive long-chain alkyl polymer.

Stirring for emulsification may be conducted by using, for example, a known stirring apparatus (for example, a homogenizer, a mixer, an ultrasonic disintegrator, or the like). For inhibiting an increase in temperature during the emulsification, the temperature of the solution mixture during the emulsification may be kept at from 0° C. to 50° C. The stirring speed of a homogenizer or mixer for emulsification, the output power of an ultrasonic disintegrator, and the emulsification time may be set depending on a desired particle size.

Next, the first solvent is described.

The first solvent may be used as a poor solvent that can form a continuous phase in the solution mixture. Examples of the first solvent include, but are not limited to, petroleum-derived high-boiling solvents such as paraffin hydrocarbon solvents, silicone oils, and fluorine-containing liquids. From the viewpoint of producing charged particles having stable dispersibility and charging properties, the first solvent may be a silicone oil when a reactive silicone polymer is used, and the first solvent may be a paraffin hydrocarbon solvent when a reactive long-chain alkyl polymer is used.

Specific examples of the silicone oil include: silicone oils having a hydrocarbon group bound to a siloxane bond, such as dimethyl silicone oil, diethyl silicone oil, methyl ethyl silicone oil, methyl phenyl silicone oil, and diphenyl silicone oil; and modified silicone oils such as fluorine-modified silicone oil, amine-modified silicone oil, carboxyl-modified silicone oil, epoxy-modified silicone oil, and alcohol-modified silicone oil. Among these, dimethyl silicone may be used from the viewpoints of high safety, high chemical stability, excellent long-term reliability, and high electrical resistivity.

The viscosity of the silicone oil is desirably from 0.1 mPa·s to 20 mPa·s, and more desirably from 0.1 mPa·s to 2 mPa·s, at a temperature of 20° C. When the viscosity falls within this range, the migration speed of particles, that is, display speed may be improved. The viscosity may be measured by using a B-8L viscometer (trade name, manufactured by TOKYO KEIKI CO., LTD.).

Examples of the paraffin hydrocarbon solvent include normal paraffin hydrocarbons having 20 or more carbon atoms (boiling point of 80° C. or more) and iso-paraffin hydrocarbons. From the viewpoints of safety and volatility, iso-paraffin may be used. Specific examples thereof include SHELLSOL 71 (manufactured by SHELL OIL CO.), ISOPAR O, ISOPAR H, ISOPAR K, ISOPAR L, ISOPAR G, and ISOPAR M (all trade names, manufactured by EXXON CORPORATION), and IP Solvent (manufactured by IDEMITSU KOSAN CO., LTD.).

Next, the second solvent is described.

The second solvent may be used as a good solvent that can form a disperse phase in the solution mixture. Further a solvent which is incompatible with the first solvent, has a boiling point lower than that of the first solvent, and dissolves the polymer having a charging group may be selected as the second solvent. The term "incompatible" as used herein refers to the state in which plural substances form independent phases and do not mix with each other. The term "dissolve" used herein refers to the state in which an undissolved material cannot be visually observed.

Examples of the second solvent include, but are not limited to: water; lower alcohols having 5 carbon atoms or less, such as methanol, ethanol, propanol, and isopropyl alcohol; tetrahydrofuran; acetone; and other organic solvents such as toluene, dimethylformamide, and dimethylacetamide.

Since the second solvent may be removed from the solution mixture system by, for example, heating under reduced pressure, the second solvent may be selected from solvents having a boiling point lower than that of the first solvent. The boiling point of the second solvent is desirably from 50° C. to 200° C., and more desirably 50° C. to 150° C.

—Process of Removing Second Solvent—

In the process of removing the second solvent, the second solvent (i.e. low-boiling solvent) is removed from the solution mixture which has been emulsified in the emulsification process. By removing the second solvent, the polymer having a charging group is precipitated and forms particles while enclosing other materials within the particles in a disperse phase formed by the second solvent, whereby colored particles are obtained. Various additives such as a pigment dispersant and a weathering stabilizer may also be included in the particles. For example, a polymer substance and a surfactant which disperse the pigment are included in a commercially-available pigment dispersion, and when such a commercially-available pigment dispersion is used, the colored particles may include these substances together with the charge control resin.

Examples of the method of removing the second solvent include a method of heating the solution mixture, a method of reducing pressure of the solution mixture, and a combination of these methods.

When the second solvent is removed by heating the solution mixture, the heating temperature is preferably, for example, from 30° C. to 200° C., and more desirably from 50° C. to 180° C. By the heating in the process of removing the second solvent, the reactive silicone polymer or the reactive long-chain alkyl polymer may also be reacted with the surfaces of the particles. When the second solvent is removed by reducing pressure of the solution mixture, the reduced pressure is preferably from 0.01 to 200 mPa, and more preferably from 0.01 to 20 mPa.

—Binding or Coating Process—

In the binding or coating process, the reactive silicone polymer or reactive long-chain alkyl polymer may be reacted in the solution (i.e. the first solvent) in which the colored particles have been formed, and may be bound to or coated on the surfaces of the colored particles. Although the reaction may have been started by the heat treatment in the process of removing the second solvent, the binding or coating process ensures the reaction.

The method of reacting the polymer and bounding to or coating on the surfaces of the colored particles may be selected depending on the type of the polymer, and examples thereof include heating of the solution.

When the solution is heated, the heating temperature is, for example, desirably from 50° C. to 200° C., and more preferably from 60° C. to 150° C.

Through the process described above, the charged particles or a charged particle dispersion including the charged particles may be obtained. If necessary, the display particle dispersion thus obtained may additionally include an acid, an alkali, a salt, a dispersant, a dispersion stabilizer, a stabilizer for preventing oxidation, for absorbing ultraviolet light, or the like, an antibacterial agent, a preservative, or the like.

A charge control agent such as an anionic surfactant, a cationic surfactant, an amphoteric surfactant, a nonionic surfactant, a fluorine-containing surfactant, a silicone surfactant, a silicone cationic compound, a silicone anionic compound, a metal soap, an alkyl phosphate, or a succinimide may be added to the thus obtained charged particle dispersion.

Examples of the charge control agent include ionic or nonionic surfactants, block or graft copolymers having lipophilic and hydrophilic moieties, compounds having a polymer chain backbone, such as cyclic, star-shaped, or dendritic polymers (dendrimers), metal complexes of salicylic acid, metal complexes of catechol, metal-containing bisazo dyes, tetraphenyl borate derivatives, and copolymers of a polymerizable silicone macromer (for example, SILAPLANE manufactured by CHISSO CORPORATION) and one of an anionic monomer or a cationic polymer.

Specific examples of the ionic or nonionic surfactants include: nonionic surfactants such as polyoxyethylene nonylphenyl ether, polyoxyethylene octylphenyl ether, polyoxyethylene dodecylphenyl ether, polyoxyethylene alkyl ether, polyoxyethylene fatty acid ester, sorbitan fatty acid ester, polyoxyethylene sorbitan fatty acid ester, and fatty acid alkylolamide; anionic surfactants such as alkylbenzene sulfonate, alkylphenyl sulfonate, alkylnaphthalene sulfonate, higher fatty acid salts, sulfate ester salts of higher fatty acid esters, and sulfonic acids of higher fatty acid esters; and cationic surfactants such as primary to tertiary amine salts and quaternary ammonium salts. The amount of the charge control agent is preferably from 0.01 to 20% by weight, and more preferably from 0.05 to 10% by weight, with respect to the solid contents of the particles.

The resultant display particle dispersion may be diluted as necessary with the first solvent (or the first solvent including a dispersant as necessary).

The concentration of the charged particles in the charged particle dispersion may be selected depending on desired display characteristics, response characteristics, or application of the dispersion, but is preferable to be selected from the range from 0.1% by weight to 30% by weight. When plural types of particles having different colors are mixed, the total amount of the particles may fall within this range. When the concentration is lower than 0.1% by weight, display density may be insufficient, while when the concentration is higher than 30% by weight, display speed may decrease and aggregation of the particles may easily occur.

EXAMPLES

Examples are described hereinafter, but embodiments are not limited to the following Examples.

—White Particle Preparation—

5 parts by weight of 2-vinylnaphthalene (manufactured by NIPPON STEEL CHEMICAL CO., LTD.), 5 parts by weight of silicone monomer FM-0721 (manufactured by CHISSO CORPORATION), 0.3 parts by weight of lauroyl peroxide (manufactured by WAKO PURE CHEMICAL INDUSTRIES, LTD.) as an initiator, and 20 parts by weight of silicone oil KF-96L-1CS (manufactured by SHIN-ETSU CHEMICAL CO., LTD.) are added to a 100 ml three-mouth flask to which a reflux condensing tube is mounted, and after carrying out bubbling by nitrogen gas for 15 minutes, polymerization is carried out at 65° C. for 24 hours in a nitrogen atmosphere.

The obtained white particles are prepared to a solid content concentration of 40% by mass in silicone oil, and white particles are obtained. At this time, the particle diameter of the white particles is 450 nm.

—Silicone Polymer A—

12 parts by mass of SILAPLANE FM-0725 (manufactured by CHISSO CORPORATION, weight average molecular weight Mw=10000) as a first silicone monomer (first silicone chain component), 36 parts by mass of SILAPLANE FM-0721 (manufactured by CHISSO CORPORATION, weight average molecular weight Mw=5000) as a second silicone monomer (second silicone chain component), 20 parts by mass of phenoxy ethylene glycol acrylate (AMP-10G manufactured by SHIN-NAKAMURA CHEMICAL CO., LTD.), and 32 parts by mass of hydroxyethyl methacrylate (manufactured by WAKO PURE CHEMICAL INDUSTRIES, LTD.) as another monomer (another polymer component), are mixed-together in 300 parts by mass of isopropyl alcohol (IPA), and 1 part by mass of AIBN (2,2-azobisisobutylnitrile) is dissolved therein as a polymerization initiator, and polymerization is carried out for 6 hours at 70° C. in nitrogen. The product formed thereby is refined by using hexane as a reprecipitation solvent and dried, and silicone polymer A is obtained.

—Silicone Polymer B—

19 parts by mass of SILAPLANE FM-0725 (manufactured by CHISSO CORPORATION, weight average molecular weight Mw=10000) as a first silicone monomer (first silicone chain component), 29 parts by mass of SILAPLANE FM-0721 (manufactured by CHISSO CORPORATION, weight average molecular weight Mw=5000) as a second silicone monomer (second silicone chain component), 9 parts by mass of methyl methacrylate (manufactured by WAKO PURE CHEMICAL INDUSTRIES, LTD.), 5 parts by mass of octafluoropentyl methacrylate (manufactured by WAKO PURE CHEMICAL INDUSTRIES, LTD.), and 38 parts by mass of hydroxyethyl methacrylate (manufactured by WAKO PURE CHEMICAL INDUSTRIES, LTD.) as another monomer (another polymer component), are mixed-together in 300 parts by mass of isopropyl alcohol (IPA), and 1 part by mass of AIBN (2,2-azobisisobutylnitrile) is dissolved therein as a polymerization initiator, and polymerization is carried out for 6 hours at 70° C. in nitrogen. The product formed thereby is refined by using hexane as a reprecipitation solvent and dried, and silicone polymer B is obtained.

—Synthesis of Cyan Migrating Particles C—

0.5 g of the above-described silicone polymer A is added to and dissolved in 9 g of isopropyl alcohol (IPA), and thereafter, 0.5 g of cyan pigment (Cyanine Blue 4973) manufactured by SANYO COLOR WORKS, LTD. is added thereto. The mixture is dispersed for 48 hours by using zirconia balls of Φ0.5 mm, and a pigment-containing polymer solution is obtained.

3 g of this pigment-containing polymer solution is taken-out and heated to 40° C. Thereafter, when 12 g of 2 CS silicone oil (manufactured by SHIN-ETSU CHEMICAL CO., LTD.: KF96) is added by drops in small amounts while applying ultrasonic waves, the silicone polymer is deposited on the pigment surface. Thereafter, the solution is heated to 60° C. and depressurized and dried, the IPA is evaporated, and cyan particles in which the silicone polymer is adhered to the pigment surface are obtained. Thereafter, by a centrifugal separator, the particles of the solution are sedimented, and the supernatant liquid is removed. 5 g of the aforementioned silicone oil is added, ultrasonic waves are applied, and washing is carried out. By a centrifugal separator, the particles are sedimented, and the supernatant liquid is removed. 5 g of the aforementioned silicone oil is further added, and a cyan particle dispersion liquid is obtained.

The volume average particle diameter of the obtained cyan particles is 0.2 μm. Note that the charge polarity of the particles in the present dispersion liquid is found to be positive charge as a result of determination by sealing the dispersion liquid between two electrode substrates, applying DC voltage, and evaluating the direction of migration.

—Synthesis of Magenta Migrating Particles M—

A magenta particle dispersion liquid is obtained in the same way as the above-described synthesis of the cyan migrating particles C, except that silicone polymer B is used instead of silicone polymer A and magenta pigment (Pigment Red 3090) is used instead of the cyan pigment in the synthesis of the cyan migrating particles C. The volume average particle diameter of the obtained magenta particles is 0.3 μm. Note that the charge polarity of the particles in the present dispersion liquid is found to be negative charge as a result of determination by sealing the dispersion liquid between two electrode substrates, applying DC voltage, and evaluating the direction of migration.

—Synthesis of Yellow Particles Y—

53 parts by mass of methyl methacrylate, 0.3 parts by mass of 2-(diethylamino)ethyl methacrylate, and 1.5 parts by mass of yellow pigment (FY7416: manufactured by SANYO COLOR WORKS, LTD.) are mixed together, and ball mill pulverization is carried out for 20 hours by zirconia balls of a diameter of 10 mm, and dispersion liquid A-1 is prepared.

Next, 40 parts by mass of calcium carbonate and 60 parts by mass of water are mixed together, and fine pulverization by ball milling is carried out in the same way as described above, and calcium carbonate dispersion liquid A-2 is prepared.

Further, 60 g of the calcium carbonate dispersion liquid A-2 and 4 g of 20% salt water are mixed together. Deaeration is carried out for 10 minutes by an ultrasonic machine, and then stirring is carried out by an emulsifying machine, and mixed liquid A-3 is prepared.

20 g of the dispersion liquid A-1, 0.6 g of ethylene glycol dimethacrylate, and 0.2 g of polymerization initiator V601 (dimethyl 2,2'-azobis(2-methylpropionate): manufactured by WAKO PURE CHEMICAL INDUSTRIES, LTD.) are measured-out and mixed sufficiently, and deaeration is carried out for 10 minutes in an ultrasonic machine. This mixture is added to above-described mixed liquid A-3, and emulsification is carried out by an emulsifying machine. Next, the emulsified liquid is placed in a flask and the flask is plugged by a silicone stopper. By using an injection needle, depressurizing and deaeration is carried out sufficiently, and nitrogen gas is sealed therein. Next, these components are reacted for 14 hours at 65° C., and particles are prepared. After cooling, the particles are filtered, and the obtained particle powder is dispersed in ion-exchange water, and calcium carbonate is decomposed in salt water, and filtering is carried out. Thereafter, washing is carried out with sufficiently distilled water, and the particle size is made uniform by using nylon sieves of mesh openings of 15 μm, 10 μm. The obtained particles have a volume average primary particle diameter of 13 μm.

Thereafter, the following surface treatment is carried out on the obtained yellow particles.

80 parts by mass of SILAPLANE FM-0711 (manufactured by CHISSO CORPORATION, weight average molecular weight Mw=1000), 2 parts by mass of glycidyl methacrylate (manufactured by WAKO PURE CHEMICAL INDUSTRIES, LTD.), and 18 parts by mass of methyl methacrylate (manufactured by WAKO PURE CHEMICAL INDUSTRIES, LTD.) are mixed together with 300 parts by mass of isopropyl alcohol (IPA), and 1 part by mass of AIBN (2,2-azobisisobutylnitrile) is dissolved therein as a polymerization initiator, and polymerization is carried out for 6 hours at 70° C. in nitrogen. Thereafter, 300 parts by mass of 2 CS silicone oil (KF96 manufactured by SHIN-ETSU CHEMICAL CO., LTD.) is added, and thereafter, by depressurizing and removing the IPA, a surface treatment agent B is obtained.

Thereafter, 2 parts by mass of the yellow particles obtained as described above, 25 parts by mass of the surface treatment agent B, and 0.01 parts by mass of triethylamine are mixed together, and are stirred for five hours at a temperature of 100°

C. Thereafter, the solvent is removed by centrifugal sedimentation, and depressurizing and drying is carried out, and the yellow particles Y that have been subjected to a surface treatment are obtained.

The volume average particle diameter of the obtained yellow particles is 13 μm, and the charge polarity when mixed-together with the above-described cyan particles C and magenta particles M is negative charge.

—Display Medium—

Two ITO glass substrates are readied, and are made to be a first electrode substrate and a second electrode substrate. TEFLON® sheets of 50 μm are used as spacers, and the second substrate is superposed above the first substrate and fixed by clips.

A mixed liquid, in which 10 parts by mass of the white particle dispersion liquid, 5 parts by mass of the cyan particles, and 5 parts by mass of the magenta particles are mixed together, is injected-in between the substrates, and a cell for evaluation is formed.

—When Carrying Out Binary Display (Display of Four Colors)—

Voltage of 30 V is applied to both electrodes for one second so that the second electrode substrate becomes positive. The dispersed, negative-charge magenta particles move toward the second electrode substrate side, the positive-charge cyan particles moves toward the first electrode substrate side, and magenta color is observed when observing from the second electrode substrate side.

Next, when voltage of 30 V is applied to both electrodes for one second so that the second electrode becomes negative, the magenta particles move toward the first electrode substrate side, the cyan particles move toward the second electrode substrate side, and cyan color is observed when observing from the second electrode substrate side.

Next, when voltage of 30 V is applied to both electrodes for 0.3 seconds so that the second electrode substrate becomes positive, and thereafter, voltage of 10 V is applied to both electrodes for one second so that the second electrode substrate becomes negative, the magenta particles and the cyan particles move as aggregates toward the second electrode substrate side, and blue color is observed when observing from the second substrate side.

Further, when voltage of 10 V is applied to both electrodes for one second so that the second electrode substrate becomes positive, aggregates of the magenta particles and the cyan particles move toward the first electrode substrate side, and white color is observed when observing from the second substrate side.

—When Displaying Magenta Gradation—

Voltage of 30 V is applied to both electrodes for one second so that the second electrode substrate becomes positive, and the negative-charge magenta particles move toward the second electrode substrate side, and the positive-charge cyan particles move toward the first electrode substrate side. Thereafter, when voltage of 30 V is applied to both electrodes for 0.3 seconds so that the second electrode substrate becomes negative, and further, voltage of 10 V is applied to both electrodes for one second so that the second electrode substrate becomes positive, the magenta particles and the cyan particles move as aggregates toward the first electrode substrate side, and white color is observed when observing from the second electrode substrate side.

Next, when, in accordance with gradation information (data) of magenta display, the desired voltage is applied to both electrodes for one second so that the second electrode substrate becomes positive, and the desired magenta density is displayed.

The desired voltage is voltage that is greater than 10 V at which the aggregates of the magenta particles and the cyan particles start to separate, and less than 30 V at which all of the aggregates separate. For example, when it is desired to make the magenta density be half of the maximum density, voltage of 20 V is applied for one second (refer to FIG. 4 and FIG. 11).

Note that the desired density is controlled by the voltage value in the above-described Example, but may be controlled by the voltage application time (pulse width).

—When Displaying Cyan Gradation—

When voltage of 30 V is applied to both electrodes for one second so that the second electrode substrate becomes positive, and thereafter, voltage of 30 V is applied to both electrodes for 0.3 seconds so that the second electrode substrate becomes negative, and further, voltage of 10 V is applied to both electrodes for one second so that the second electrode substrate becomes positive, the magenta particles and the cyan particles move as aggregates toward the first electrode substrate side, and white color is observed when observing from the second electrode substrate side.

Next, when, in accordance with gradation data of cyan display, the desired voltage is applied to both electrodes for one second so that the second electrode substrate becomes positive, a blue color in which the cyan is strong is displayed.

Next, when voltage of 8 V is applied to both electrodes for one second so that the second electrode substrate becomes negative, the aggregates of the magenta particles and the cyan particles move toward the first electrode substrate side, and the desired cyan density is displayed.

The desired voltage is voltage that is greater than 10 V at which the aggregates of the magenta particles and the cyan particles start to separate, and less than 30 V at which all of the aggregates separate. For example, when it is desired to make the cyan density be half of the maximum density, voltage of 20 V is applied for one second (refer to FIG. 4 and FIG. 11). Further, the voltage of 8 V is a voltage at which the aggregates do not separate and all of the aggregates can move to one electrode substrate side.

Note that the desired density is controlled by the voltage value in the above-described Example, but may be controlled by the voltage application time (pulse width).

—When Displaying Blue Gradation—

When voltage of 30 V is applied to both electrodes for one second so that the second electrode substrate becomes positive, and thereafter, voltage of 30 V is applied to both electrodes for 0.3 seconds so that the second electrode substrate becomes negative, and further, voltage of 10 V is applied to both electrodes for one second so that the second electrode substrate become positive, the magenta particles and the cyan particles move as aggregates toward the first electrode substrate side, and white color is observed when observing from the second electrode substrate side.

Next, when, in accordance with gradation data of blue display, the desired voltage is applied to both electrodes for one second so that the second electrode substrate becomes negative, the desired blue density is displayed.

The desired voltage is a voltage that is smaller than 10 V at which the aggregates of the magenta particles and the cyan particles start to separate, and greater than 3 V at which the aggregates start to move, and smaller than 8 V at which all of the aggregates move. For example, when it is desired to make the blue density be half of the maximum density, voltage of 5 V is applied for one second (refer to FIG. 5 and FIG. 11).

Note that the desired density is controlled by the voltage value in the above-described Example, but may be controlled by the voltage application time (pulse width).

—When Displaying Gradation with the Ratios of Magenta and Cyan being Different (the Magenta Density being Higher than the Cyan Density)—

When voltage of 30 V is applied to both electrodes for one second so that the second electrode substrate becomes positive, and thereafter, voltage of 30 V is applied to both electrodes for 0.3 seconds so that the second electrode substrate becomes negative, and further, voltage of 10 V is applied to both electrodes for one second so that the second electrode substrate becomes positive, the magenta particles and the cyan particles move as aggregates toward the first electrode substrate side, and white color is observed when observing from the second electrode substrate side.

Next, the desired voltage is applied to both electrodes for one second so that the second electrode substrate becomes positive, in order to separate aggregates of an amount corresponding to the difference obtained by subtracting the necessary amount of cyan from the necessary amount of magenta, and to move the separated magenta particles to the second electrode substrate side. Due thereto, a pale magenta color is displayed.

Here, the desired voltage is a voltage that is larger than 10 V at which the aggregates of the magenta particles and the cyan particles start to separate, and smaller than 30 V at which all of the aggregates separate. For example, when it is desired to make the magenta density be 80% of the maximum density and make the cyan density be 50% of the maximum density, voltage of 15 V is applied to both electrodes for one second so that the second electrode substrate becomes positive, in order to separate 80−50=30% of the magenta particles and move the separated magenta particles to the second electrode substrate side (see FIG. 6).

Next, voltage of 6 V is applied to both electrodes for one second so that the second electrode substrate becomes negative, in order to move, to the second electrode substrate side, aggregates of 50% of each of the remaining magenta particles and cyan particles needed for display, among the aggregates of the magenta particles and cyan particles that have moved to the first electrode substrate side. Due thereto, aggregates of the desired amounts of the magenta particles and cyan particles move toward the second electrode substrate side, and blue is displayed in the desired ratios of magenta particles and cyan particles (see FIG. 6).

Note that the desired density is controlled by the voltage value in the above-described Example, but may be controlled by the voltage application time (pulse width).

—When Displaying Gradation with the Ratios of Magenta and Cyan being Different (the Cyan Density being Higher than the Magenta Density)—

When voltage of 30 V is applied to both electrodes for one second so that the second electrode substrate becomes positive, and thereafter, voltage of 30 V is applied to both electrodes for 0.3 seconds so that the second electrode substrate becomes negative, and further, voltage of 10 V is applied to both electrodes for one second so that the second electrode substrate become positive, the magenta particles and the cyan particles move as aggregates toward the first electrode substrate side, and white color is observed when observing from the second electrode substrate side.

Next, the desired voltage is applied to both electrodes for one second so that the second electrode substrate becomes negative, in order to separate aggregates of an amount corresponding to the difference obtained by subtracting the necessary amount of magenta from the necessary amount of cyan, and to move the separated cyan particles to the second electrode substrate side. Due thereto, a blue color in which the cyan was strong was displayed.

Here, the desired voltage is a voltage that is larger than 10 V at which the aggregates of the magenta particles and the cyan particles start to separate, and smaller than 30 V at which all of the aggregates separate. For example, when it is desired to make the cyan density be 80% of the maximum density and make the magenta density be 50% of the maximum density, voltage of 15 V is applied to both electrodes for one second so that the second electrode substrate becomes negative, in order to separate 80−50=30% of the cyan particles and move the separated cyan particles to the second electrode substrate side (see FIG. 6).

Next, voltage of 4 V is applied to both electrodes for one second so that the second electrode substrate becomes positive in order to, among the aggregates of the magenta particles and cyan particles that have moved to the second electrode substrate side, leave aggregates of 50% of each of the remaining magenta particles and cyan particles needed for display, and move aggregates of an amount of the excess 20% to the first electrode substrate side. Due thereto, the aggregates of the excess magenta particles and cyan particles move toward the first electrode substrate side, and blue is displayed in the desired ratios of magenta particles and cyan particles (see FIG. 6).

Note that the desired density is controlled by the voltage value in the above-described Example, but may be controlled by the voltage application time (pulse width).

—When Displaying Gradation in a Three-Particle System (Gradation Display of Cyan Density, Magenta Density, Yellow Density in Desired Ratios)—

The yellow particles are charged negative. Further, as mentioned above, the aggregating force with the magenta particles, that have the same polarity, is of course small, and the aggregating force with the positive-charge cyan particles is also small. Therefore, the yellow particles separate from these and move at a voltage ($|V|<|Vg1|$) at which the aggregates of the magenta particles and the cyan particles do not move.

Accordingly, it suffices to, in accordance with the image data, first, move and adhere desired amounts of the magenta particles and the cyan particles, and the aggregates thereof, to the desired substrate side by the driving method that has been described heretofore, and thereafter, move the desired amount of the yellow particles to the second electrode substrate side, or leave the desired amount of the yellow particles at the second electrode substrate side and move the excess yellow particles to the first electrode substrate side. At the time when the desired amounts of the magenta particles and the cyan particles and the aggregates thereof are moved and adhered to the desired substrate side, if the voltage that is applied lastly is such that the second electrode substrate side is positive, the yellow particles are positioned at the second electrode substrate side. Conversely, if the voltage that is applied lastly is such that the second electrode substrate side is negative, the yellow particles are positioned at the second electrode substrate side).

For example, when the yellow particles are positioned at the first electrode substrate side, the desired voltage is applied in accordance with the image data to both electrodes for one second so that the second electrode substrate becomes positive.

Here, the desired voltage is a voltage at which the aggregates of the magenta particles and the cyan particles do not move ($0<V<3$ V). For example, when it is desired to make the yellow density half of the maximum density, voltage of 1.5 V is applied for one second (see FIG. 10, FIG. 11).

Further, when the yellow particles are positioned at the second electrode substrate side, the desired voltage is applied in accordance with the image data to both electrodes for one second so that the second electrode substrate becomes negative. For example, when it is desired to make the yellow density 30% of the maximum density, voltage of 2 V is applied for one second (see FIG. 10, FIG. 11).

Note that, as compared with the cyan particles and the magenta particles and the aggregates thereof, the large-diameter yellow particles have a low threshold value and high responsiveness. Therefore, even when the voltage application time is short, the yellow particles can be driven, but the other particles cannot respond, and the upper threshold value characteristic of the particles other than the yellow particles apparently shifts toward the high voltage side. For example, if the applied voltage time is 0.1 seconds, the particles and aggregates other than the yellow particles cannot move even if the voltage is raised to 10 V.

Utilizing this, when, for example, the yellow particles are positioned at the first electrode substrate side and it is desired to make the yellow density be half of the maximum density, it suffices to apply voltage of 7 V to both electrodes for 0.1 seconds so that the second electrode substrate becomes positive. In accordance therewith, the display rewriting time is greatly shortened (see FIG. 10, FIG. 11).

The display device relating to the present exemplary embodiments has been described above, but embodiments are not limited to the above-described exemplary embodiments.

For example, four or more types of electrophoretic particle groups, in which at least two types of particle groups aggregate with one another and form aggregates, may be used. When four types of electrophoretic particles groups are used for example, two types of particles groups may aggregate with one another and the other two types of particle groups may be particle groups that do not aggregate with other particle groups. Or, two of three types of particle groups may aggregate at respectively different aggregating forces, and the other one type of particle group may be a particle group that does not aggregate with other particle groups. Or, two of the four types of particle groups may be particle groups that form aggregates at respectively different aggregating forces.

The particle group that does not migrate is not limited to the white particle group, and, for example, a black particle group may be used.

What is claimed is:

1. A driving device of a display medium that includes:

a display substrate that is light-transmissive;

a rear substrate that is disposed so as to face the display substrate with a gap therebetween;

electrodes including a front electrode that is disposed at the display substrate and is light-transmissive and a rear electrode that is disposed at the rear substrate;

a dispersion medium that is disposed between the front electrode and the rear electrode; and two or more types of particle groups that are dispersed in the dispersion medium and that include a first particle group and a second particle group having different colors and charge polarities, the first particle group and the second particle group migrating independently of each other and away from each other due to a first potential difference being imparted between the electrodes for a first time period, the first particle group and the second particle group respectively adhering to a display substrate side and a rear electrode side of the display medium, the first particle group and the second particle group forming aggregates, that have an overall positive or negative charge, due to the first potential difference being imparted between the electrodes, with opposite polarity to the polarity of the first potential difference that causes the first particle group and the second particle group to migrate away from each other, for a second time period that is shorter than the first time period, wherein the aggregates are formed by grouping the first particle group and the second particle group together, the formed aggregates migrating together due to a second potential difference being imparted that is smaller than the first potential difference, the driving device comprising a potential difference imparting section that:

imparts, between the electrodes, the first potential difference that forms the aggregates;

imparts, between the electrodes, a third potential difference that dissociates a portion of the first particle group and a portion of the second particle group from the formed aggregates and moves, to the display substrate side, a particle group corresponding to the portion of the first particle group or the portion of the second particle group for which a greater amount of particles is needed for a gradation display of a particular gradation, in an amount of a difference between an amount of particles of the first particle group and an amount of particles of the second particle group needed for the gradation display;

when the particle group for which a greater amount of particles is needed for the gradation display has an opposite polarity to the aggregates, the potential difference imparting section imparts, between the electrodes, a fourth potential difference that moves the particle group and an amount of the aggregates needed for the gradation display toward the display substrate side; and when the particle group of which a greater amount of particles is needed for the gradation display has a same polarity as the aggregates, the potential difference imparting section imparts, between the electrodes, a fifth potential difference that moves the particle group and an amount of the aggregates not needed for the gradation display toward the rear substrate side.

2. The driving device of a display medium of claim 1, wherein the display medium has a third particle group that is dispersed in the dispersion medium, that at least migrates independently due to a sixth potential difference being imparted between the electrodes for the first time period, and whose aggregating force with respect to the first particle group and the second particle group is weaker than an aggregating force between the aggregates of the first particle group and the second particle group.

3. The driving device of a display medium of claim 2, wherein the potential difference imparting section causes the third particle group to migrate independently by imparting a seventh potential difference, that is greater than the sixth potential difference, for a third time period that is shorter than the first time period.

4. The driving device of a display medium of claim 2, wherein the third particle group has an opposite polarity to the aggregates.

5. The driving device of a display medium of claim 2, wherein the first particle group and the second particle group are respectively made up of particles that can pass through between particles of the third particle group, and the third particle group has higher responsiveness, with respect to a potential difference imparted between the electrodes, than the first particle group and the second particle group.

6. The driving device of a display medium of claim 2, wherein a particle diameter of particles of the third particle group is 10 or more times greater than a particle diameter of particles of the first particle group and a particle diameter of particles of the second particle group.

7. A non-transitory medium storing a program that causes a computer to execute a process of driving a display medium, the display medium including:

a display substrate that is light-transmissive;

a rear substrate that is disposed so as to face the display substrate with a gap therebetween;

electrodes including a front electrode that is disposed at the display substrate and is light-transmissive and a rear electrode that is disposed at the rear substrate;

a dispersion medium that is disposed between the front electrode and the rear electrode; and two or more types of particle groups that are dispersed in the dispersion medium and that include a first particle group and a second particle group having different colors and charge polarities, the first particle group and the second particle group migrating independently of each other and away from each other due to a first potential difference being imparted between the electrodes for a first time period, the first particle group and the second particle group respectively adhering to a display substrate side and a rear electrode side of the display medium, the first particle group and the second particle group forming aggregates, that have an overall positive or negative charge, due to the first potential difference being imparted between the electrodes, with opposite polarity to the polarity of the first potential difference that causes the first particle group and the second particle group to migrate away from each other, for a second time period that is shorter than the first time period, wherein the aggregates are formed by grouping the first particle group and the second particle group together, the formed aggregates migrating together due to a second potential difference being imparted that is smaller than the first potential difference, the process of driving comprising:

imparting, between the electrodes, the first potential difference that forms the aggregates;

imparting, between the electrodes, a third potential difference that dissociates a portion of the first particle group and a portion of the second particle group from the formed aggregates and moves, to the display substrate side, a particle group corresponding to the portion of the first particle group or the portion of the second particle group for which a greater amount of particles is needed for a gradation display of a particular gradation, in an amount of a difference between an amount of particles of the first particle group and an amount of particles of the second particle group needed for the gradation display;

when the particle group for which a greater amount of particles is needed for the gradation display has an opposite polarity to the aggregates, the driving imparting, between the electrodes, a fourth potential difference that moves the particle group and an amount of the aggregates needed for the gradation display toward the display substrate side; and when the particle group of which a greater amount of particles is needed for the gradation display has a same polarity as the aggregates, the driving imparting, between the electrodes, a fifth potential difference that moves the particle group and an amount of the aggregates not needed for the gradation display toward the rear substrate side.

8. A method of driving a display medium, the display medium including:

a display substrate that is light-transmissive;

a rear substrate that is disposed so as to face the display substrate with a gap therebetween;

electrodes including a front electrode that is disposed at the display substrate and is light-transmissive and a rear electrode that is disposed at the rear substrate;

a dispersion medium that is disposed between the front electrode and the rear electrode; and two or more types of particle groups that are dispersed in the dispersion medium and that include a first particle group and a second particle group having different colors and charge polarities, the first particle group and the second particle group migrating independently of each other and away from each other due to a first potential difference being imparted between the electrodes for a first time period, the first particle group and the second particle group respectively adhering to a display substrate side and a rear electrode side of the display medium, the first particle group and the second particle group forming aggregates, that have an overall positive or negative charge, due to the first potential difference being imparted between the electrodes, with opposite polarity to the polarity of the first potential difference that causes the first particle group and the second particle group to migrate away from each other, for a second time period that is shorter than the first time period, wherein the aggregates are formed by grouping the first particle group and the second particle group together, the formed aggregates migrating together due to a second potential difference being imparted that is smaller than the first potential difference, the method comprising:

imparting, between the electrodes, the first potential difference that forms the aggregates;

imparting, between the electrodes, a third potential difference that dissociates a portion of the first particle group and a portion of the second particle group from the formed aggregates and moves, to the display substrate side, a particle group corresponding to the portion of the first particle group or the portion of the second particle group for which a greater amount of particles is needed for a gradation display of a particular gradation, in an amount of a difference between an amount of particles of the first particle group and an amount of particles of the second particle group needed for the gradation display;

when the particle group for which a greater amount of particles is needed for the gradation display has an opposite polarity to the aggregates, the driving imparting, between the electrodes, a fourth potential difference that moves the particle group and an amount of the aggregates needed for the gradation display toward the display substrate side; and when the particle group of which a greater amount of particles is needed for the gradation display has a same polarity as the aggregates, the driving imparting, between the electrodes, a fifth potential difference that moves the particle group and an amount of the aggregates not needed for the gradation display toward the rear substrate side.

9. A display device comprising the display medium and the potential difference imparting section of claim 1.

* * * * *